US006781476B2

(12) United States Patent
Tsunoda et al.

(10) Patent No.: US 6,781,476 B2
(45) Date of Patent: Aug. 24, 2004

(54) FILTER HAVING DIRECTIONAL COUPLER AND COMMUNICATION DEVICE

(75) Inventors: Kikuo Tsunoda, Osaka-fu (JP); Yasunori Takei, Kyoto (JP); Hiromitsu Ito, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 23 days.

(21) Appl. No.: 10/337,855

(22) Filed: Jan. 8, 2003

(65) Prior Publication Data

US 2003/0184407 A1 Oct. 2, 2003

(30) Foreign Application Priority Data

Jan. 8, 2002 (JP) ..... 2002-001792

(51) Int. Cl.[7] ..... H01P 1/202; H01P 1/203; H01P 1/205; H01P 1/208; H01P 5/18

(52) U.S. Cl. ..... 333/110; 333/33; 333/109; 333/185; 333/212; 333/219.1

(58) Field of Search ..... 333/109, 110, 333/112, 33, 136, 137, 185, 212, 219, 219.1, 227, 230

(56) References Cited

U.S. PATENT DOCUMENTS

| | | | | |
|---|---|---|---|---|
| 4,327,330 A | * | 4/1982 | Ranghelli | 330/56 |
| 4,536,725 A | | 8/1985 | Hubler | |
| 4,821,006 A | * | 4/1989 | Ishikawa et al. | 333/202 |
| 4,942,377 A | * | 7/1990 | Ishikawa et al. | 333/202 |
| 5,894,250 A | | 4/1999 | Ravaska et al. | |

FOREIGN PATENT DOCUMENTS

| | | |
|---|---|---|
| EP | 0 560 503 A1 | 9/1993 |
| EP | 0 828 308 A1 | 3/1998 |
| JP | 6-120708 | 4/1994 |
| JP | 6-132710 | 5/1994 |
| JP | 9-270732 | 10/1997 |
| JP | 11-220312 | 8/1999 |
| JP | 2001-94315 | 4/2001 |

OTHER PUBLICATIONS

Copy of European Search Report dated Nov. 7, 2003.

* cited by examiner

*Primary Examiner*—Robert Pascal
*Assistant Examiner*—Dean Takaoka
(74) *Attorney, Agent, or Firm*—Dickstein, Shapiro, Morin & Oshinsky, LLP.

(57) ABSTRACT

An inner conductor comprising high impedance portions and low impedance portions alternately connected to each other is disposed in the center of an outer conductor having a substantially square cross-section. Two holes are formed in one side of the outer conductor so as to extend through the wall of the outer conductor. A substantially π-shaped coupling line comprising a main line portion and probe-connecting portions is formed on the surface of a dielectric substrate. Probes made of conductor rods are connected at the ends, respectively. A resistor is provided at one end of the main line of the coupling line. The other end of the main line functions as an output terminal, and can be connected to an external circuit. The probes are inserted through the holes. The dielectric substrate is disposed inside of the outer conductor at predetermined positions.

24 Claims, 26 Drawing Sheets

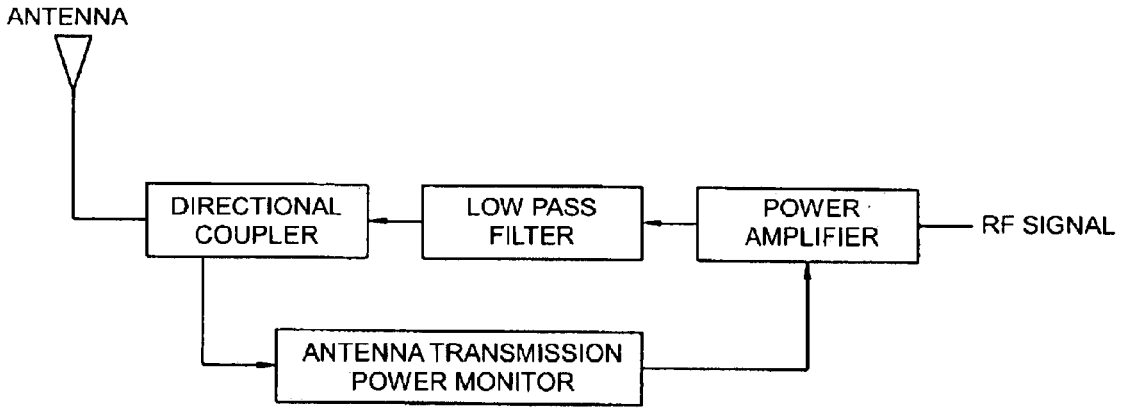
FIG. 1 – PRIOR ART

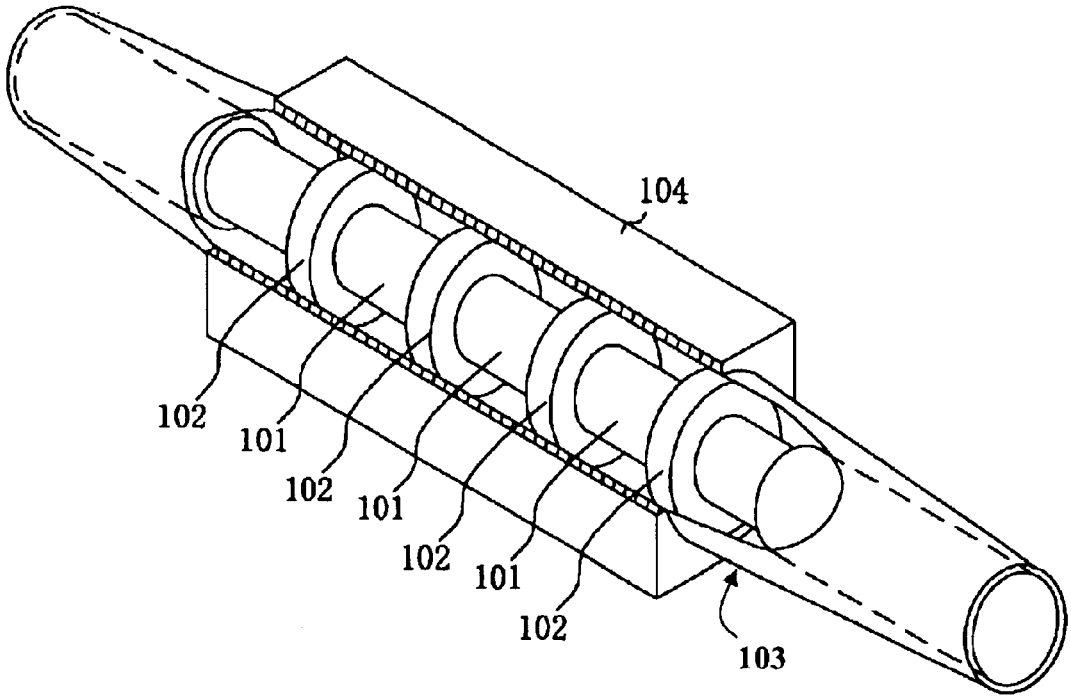
FIG. 2 – PRIOR ART

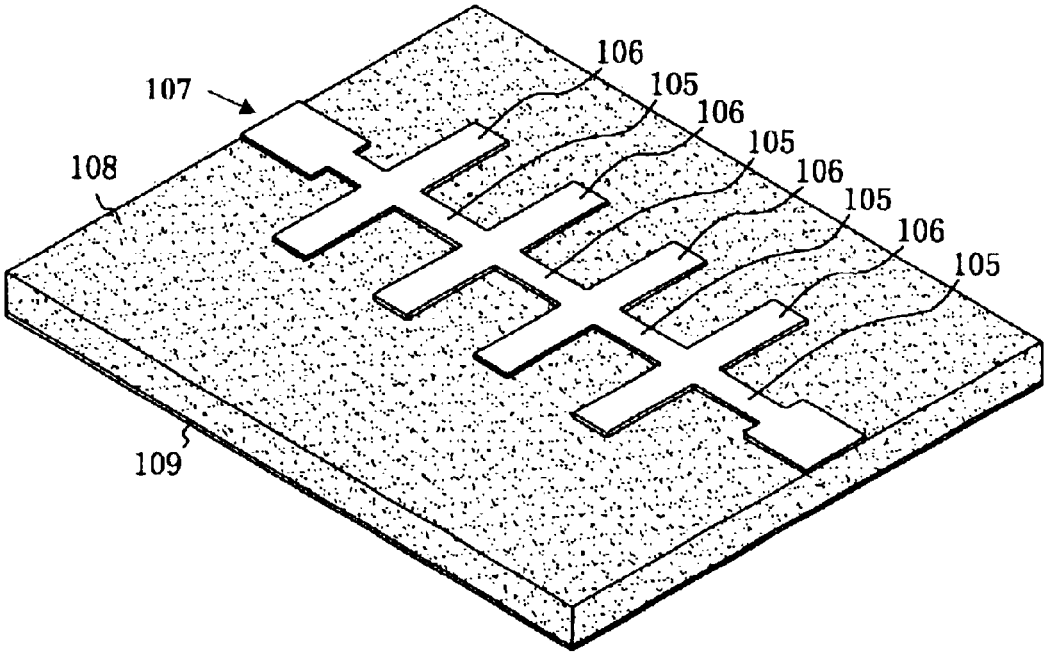
FIG. 3 – PRIOR ART

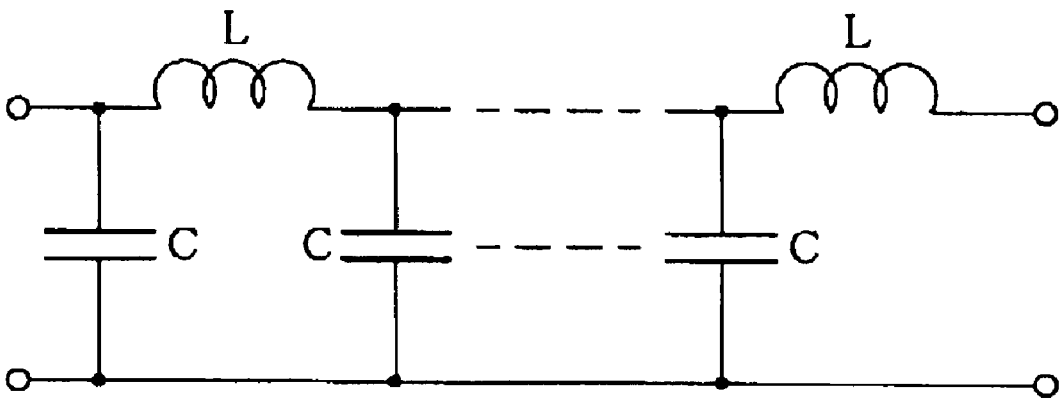
FIG. 4 – PRIOR ART

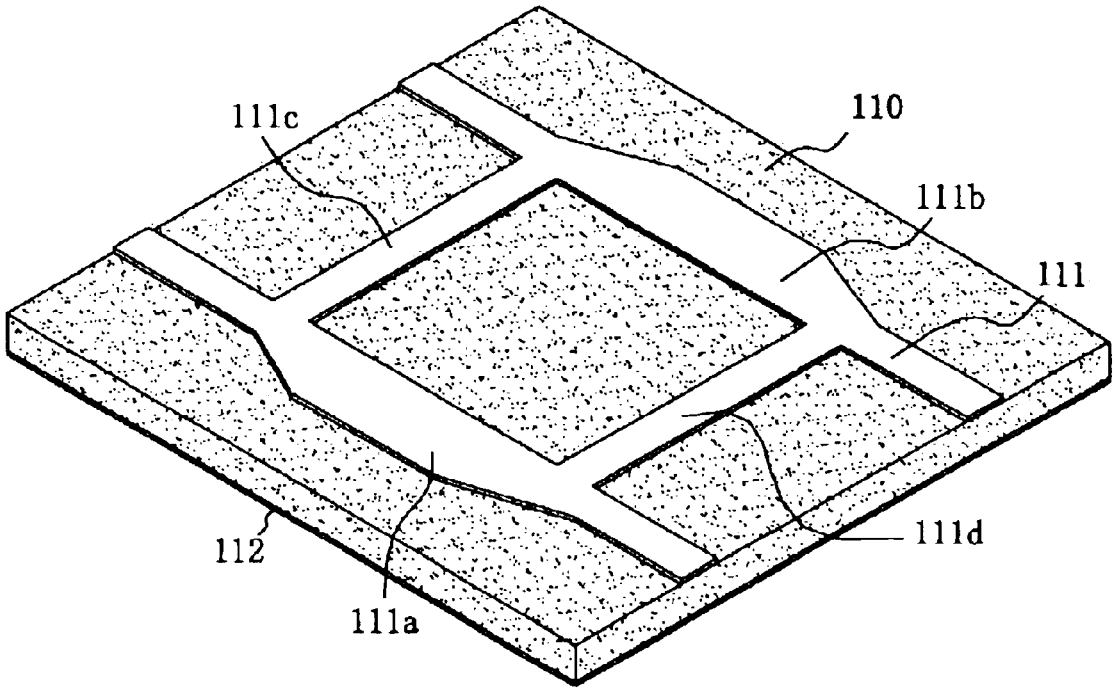
FIG. 5 – PRIOR ART

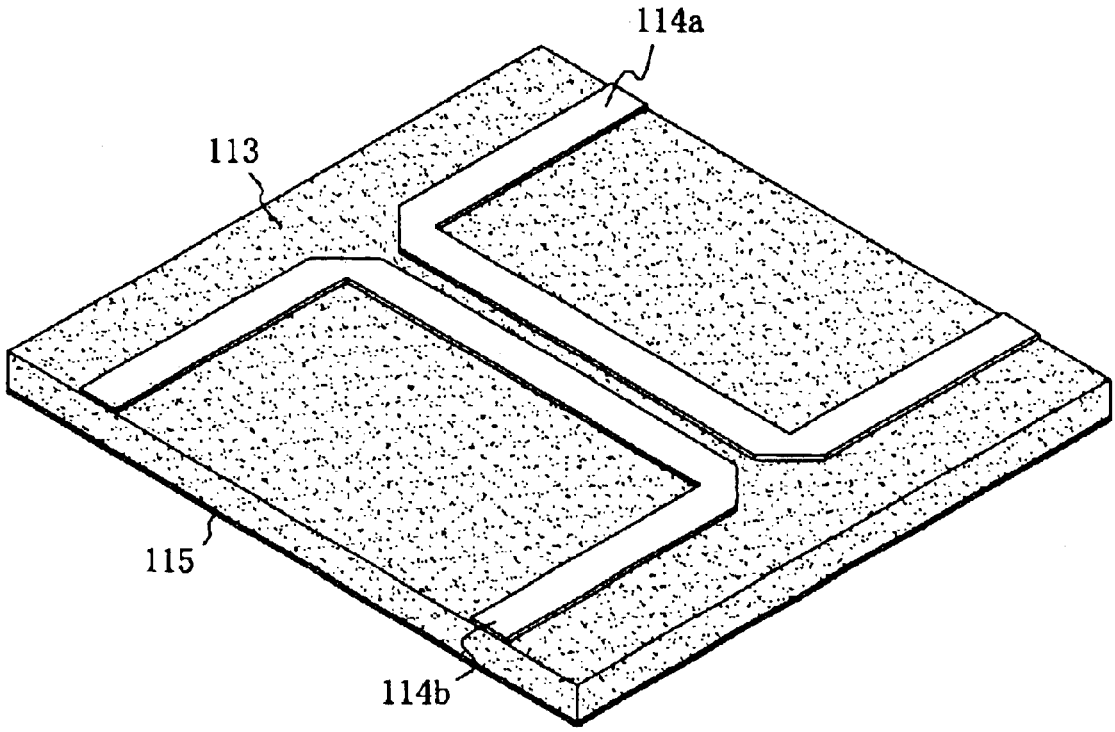
FIG. 6 – PRIOR ART

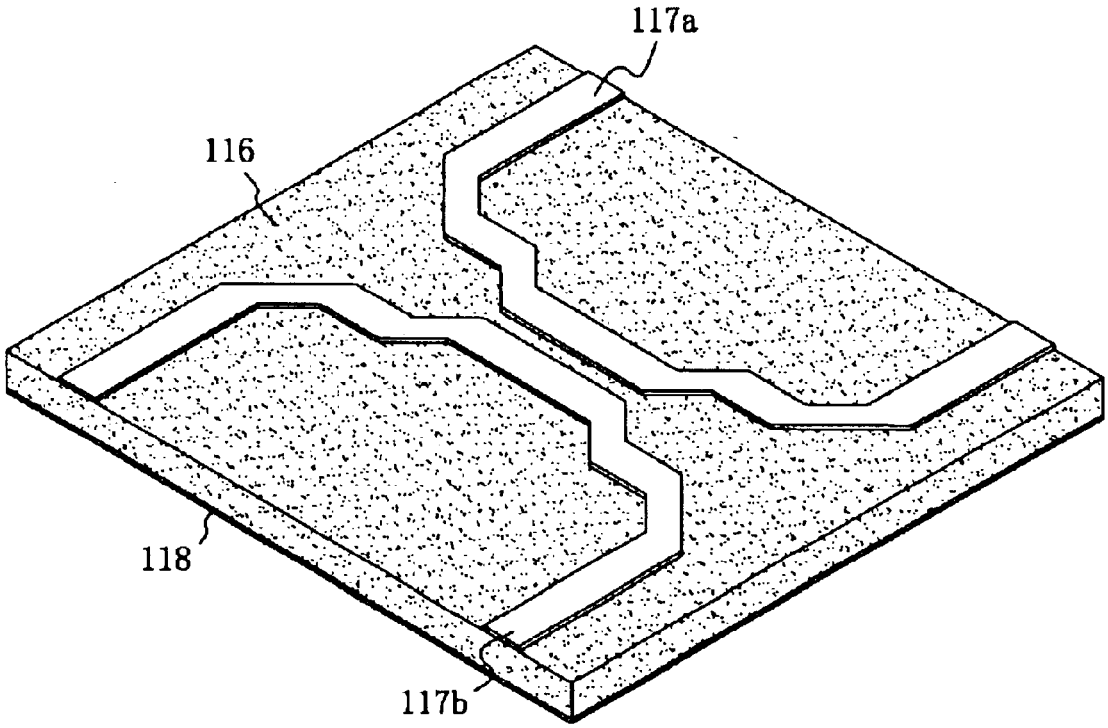
FIG. 7 – PRIOR ART

PRIOR ART

FILTER HAVING DIRECTIONAL COUPLER AND COMMUNICATION DEVICE

BACKGROUND OF THE INVENTION

1. Field of the Invention

The present invention relates to a filter having a directional coupler for use in microwave communication, and more particularly to a filter containing a directional coupler therein, a composite filter device and a communication device each including the same.

2. Description of the Related Art

Generally, a filter is disposed at the first stage in a communication device, and to check the operation of the communication device, a directional coupler is provided. FIG. 1 is a block diagram of such a communication device such as a portable telephone or the like.

Referring to FIG. 1, a power amplifier power-amplifies a transmission signal, and a low-pass filter attenuates the higher harmonics of the signal. A directional coupler outputs a part of the transmission signal to the antenna transmission power monitor. The antenna transmission power monitor detects the input signal and adjusts the output of the power amplifier, which is transmitted to the antenna via the directional coupler. Thus, the output of the antenna to be radiated externally is continuously stabilized.

Such methods of designing filters for use in microwave communication as described above are known. For example, a low-pass filter using a coaxial line, a comb line filter, a waveguide filter, and so forth are described in: Matthaei and others, "Microwave Filters, Impedance-Matching and Networks, and Coupling Structure", Artech House Co. Moreover, methods of designing a low-pass filter and a band-pass filter using microstrip lines are described in Konishi, "Design and Application of Filter Circuit for Communication", Sougou-Denshi Shuppan (1994).

FIGS. 2 and 3 show typical low-pass filters produced by the above-mentioned methods.

FIG. 2 is an exploded perspective view of a low-pass filter using a coaxial line. FIG. 3 is a perspective view of a microstrip type low-pass filter.

The low-pass filter shown in FIG. 2 comprises an inner conductor 103 arranged in an outer conductor 104. The inner conductor 103 comprises high impedance portions 101 and low impedance portions 102 alternately connected to each other. In each high impedance portion 101, the size of a plane perpendicular to the signal propagation direction is small and the axial length is large. In each low impedance potion 102, the size of a plane perpendicular to the signal propagation direction is large and the axial length is small.

The low-pass filter shown in FIG. 3 contains a line electrode 107 formed on the front surface of a dielectric substrate 108 and a ground electrode 109 formed on the back surface of the dielectric substrate 108. The line electrode 107 comprises high impedance portions 105 and low impedance portions 106 which are alternately arranged. For each high impedance portion 105, the width with respect to the signal propagation direction is small, and the length is large. For each low impedance portion 106, the width is large, and the length is small.

Since the high impedance portions and the low impedance portions are alternately arranged as described above, the high and low impedance portions function as inductors and capacitors, respectively. FIG. 4 is an equivalent circuit diagram of the above-described low-pass filter. Thus, the low-pass filter comprising a multi-stage LC ladder circuit is formed.

Techniques for designing directional couplers are described in "Microwave Circuit for Communication", The Institute of Electronics, Information, and Communication Engineers (1981). FIGS. 5 and 6 show well-known typical structures of the couplers.

FIG. 5 is a schematic view of a hybrid circuit. FIG. 6 is a schematic view of a transverse coupling type directional coupler.

In the hybrid circuit shown in FIG. 5, a main line 111 is formed on the front surface of a dielectric substrate 110, and a ground electrode 112 is formed on the opposite surface of the substrate 110. The lengths of the line portions 111*a* to 111*d* of the main line 111 are set to be equal to a quarter of the wavelength of a transmission signal, respectively, so that the characteristic impedances of the respective lines can be matched with each other.

Moreover, the transverse coupling type directional coupler shown in FIG. 6 contains a distributed coupling line in which a main line 114*a* and a coupling line 114*b* adjacent to the main line 114*a* are formed on the front surface of a dielectric substrate 113 which has a ground electrode 115 formed on the back surface thereof. The smaller the line length of the coupling portion becomes, the more the directivity decreases. A superior directivity can be attained by setting the line length at a quarter of the wavelength of a transmission signal.

It is generally known that to increase the width of the frequency band in which the directivity can be attained, line conductors in a coupling portion have a multistage structure. FIG. 7 shows a transverse coupling type directional coupler having the above-described multistage structure. In FIG. 7, a dielectric substrate 116, a main line 117*a*, a coupling line 117*b*, and a ground electrode 118 are shown.

For the transverse coupling type directional coupler, the coupling degree has a limitation since the size is regulated. Thus, according to the structure shown in FIGS. 8A and 8B, coupling degree adjusting conductors 121*a* and 121*b* are arranged on a coupling portion so as to sandwich a dielectric. In FIGS. 8A and 8B, a dielectric substrate 119, a main line 120*a*, a coupling line 120*b*, and a ground electrode 122 are shown. The first layer formed on the dielectric substrate 119 is the same as the circuit shown in FIG. 6.

Communication devices provided with the above described filters and directional couplers still have the following problems.

In particular, a filter and a directional coupler are separately formed in the prior art communication devices. Thus, the size of the device is increased. Moreover, since a signal is transmitted via the two elements, the number of sites in which loss is generated when a signal passes the sites is increased. Thus, as a whole, the transmission loss is increased.

To solve the above-described problem, a method for forming a filter and a directional coupler on the same substrate or in the same case has been devised and disclosed.

Examples of such method are disclosed in Japanese Unexamined Patent Application Publication No. 6-120708, Japanese Unexamined Patent Application Publication No. 9-270732, Japanese Unexamined Patent Application Publication No. 11-220312, and Japanese Unexamined Patent Application Publication No. 2001-94315.

As described in Japanese Unexamined Patent Application Publication No. 6-120708, resonators constituting a filter and input-output terminals are connected to lines, respectively. A coupling line is formed adjacent to the 4 transmission lines to produce a directional coupler.

According to Japanese Unexamined Patent Application Publication No. 9-270732, a coupling line is arranged adjacent to a transmission line which constitutes a band-pass filter, formed on a dielectric substrate, as a demultiplexer, whereby a directional coupler is formed.

According to Japanese Unexamined Patent Application Publication No. 11-220312, a coupling line is arranged in the position where the line is to be coupled to the coil pattern portion of a low pass filter which is made of inner electrodes in a laminated multi-layer substrate, and is coupled to the coil pattern portion, whereby a directional coupler is formed.

According to Japanese Unexamined Patent Application Publication No. 2001-94315, a directional coupler comprises two coupling lines adjacent to each other. Lines which function as capacitors are arranged at both the ends of a main line of the coupling lines, so that the main line operates as an inductor. Thus, a low-pass filter is formed.

In the case of these integral devices comprising the directional couplers and the filters, a coupling line is arranged so as to be coupled to a transmission line which constitutes a filter, whereby a directional coupler is formed. For this configuration, a component which can constitute the coupling line in the filter is required. Moreover, a sufficient length must be ensured for the coupling portion to attain a coupling degree which provides a sufficient directivity in the case of a transverse coupling type directional coupler. When the transverse coupling type directional coupler is combined with a low-pass filter comprising pattern electrodes, the length of the line constituting the low-pass filter becomes shorter than a quarter of the wavelength of a transmission signal. Therefore, the length of the coupling line is insufficient, and thus, the directivity which can be attained has a limit.

Moreover, problems are caused in that the directivity characteristic or the like is difficult to control when the electrical length of the coupling line is short.

In band-pass filters, the structure in which a band-pass characteristic is attained by use of the coupling between the resonators constituting a filter is predominantly employed. These devices have no main lines. Accordingly, a directional coupler using a coupling line system can not be formed between resonators.

Moreover, the structure in which a resonator is connected to a line having a length equal to a quarter of the wavelength of a transmission signal is dominantly employed in band-stop filters. However, a superior directivity can not be obtained even if a coupling line comprising simple parallel two conductors is provided, since a complicated standing-wave is generated inside of the filter.

SUMMARY OF THE INVENTION

Accordingly, it is an object of the present invention to provide a filter having a directional coupler which has a simple structure, a good coupling characteristic and a superior directivity, a composite filter device, and a communication device, and to provide a method of adjusting the directional coupler.

To achieve the above-described object, according to the present invention, a part of a transmission signal is picked up at plural sites in the filter. The phases of the signals are controlled and synthesized by means of a circuit pattern to realize the characteristics with which the directional coupler performs its function with respect to input or output of the filter. According to this configuration, the filter is not required to contain a transmission line portion. The phases of the picked-up signals are controlled and synthesized, and thereby, the directivity characteristic at a desired frequency is enhanced while influences upon the filter characteristic are suppressed.

The principle of this configuration will be described with reference to FIG. 9 which is an equivalent circuit diagram of a filter having a directional coupler.

In FIG. 9, a filter 150 and a directional coupler 151 are shown. The filter 150 is provided with two input-output terminals, that is, a port 1 and a port 2 each of which can function as an input and/or output terminal. Each of the ports 1 and 2 comprise at least two resonators having a characteristic impedance Z. On the other hand, the directional coupler 151 is provided with two external input-output terminals, that is, a port 3 and a port 4, and is coupled to the filter via ports A and B. The electrical angles of the lines between the port A and the port 3, between the port B and the port 4, and between the port 3 and the port 4 are represented by $\theta_a$, $\theta_b$, and $\theta_0$, respectively.

In this circuit, a transmission signal is picked up via two sites, that is, the ports A and B. The signals transmitted via the port 1 and the ports A and B reach the port 3 to overlap each other, giving a large signal, while the signals reaching the port 4 are canceled by each other. In this case, the circuit functions as a directional coupler. Needless to say, when the signals reaching the port 4 overlap each other, and the signals reaching the port 3 are cancelled by each other, and the circuit also functions as a directional coupler. In particular, directivity can be attained by appropriately setting the intensities of the signals picked up at the ports A and B, the propagation phase of the line between the port A and the port 3, and the propagation phase of the line between the port B and the port 4. Therefore, it is unnecessary to set the phase difference between the transmission signals picked up at the ports A and B at $\pi/2$.

The coupling element constituting the port A comprises an appropriate combination of, e.g., a conductor loop, a line electrode connected to the conductor loop, a stub connected thereto, and the like. The propagation phase is adjusted by selection of materials and shapes for the loop, the length of the line electrode, and the shapes, sizes, and arrangement position of the stub.

This principle can be applied to a multi-stage configuration of the coupling portion. That is, the number of ports through which signals are picked up from the filter may be increased and combined with each other for the configuration.

In a practical circuit, the phase difference between signals at the ports A and B of a signal input via the port 1 is different from that between signals at the ports A and B of a signal input via the port 2. However, this problem can be solved by setting and combination of the line lengths in the directional coupler. Thus, superior directivity and coupling degree can be obtained.

For simple illustration of this principle, the following is assumed. That is, one half of a signal from the port A flows to the port 3, and the other half flows to the port 4. Moreover, one half of a signal from the port B flows to the port 3, and the other half flows to the port 4. The phase differences between the signals at the ports A and B is represented by $\theta_1$ for a signal input via the port 1, and $-\theta_2$ for a signal input via the port 2. The amplitudes are represented by 2W. It should be noted that the signs of $\theta_1$ and $-\theta_2$ are opposite, since the propagation directions are different from each other.

In the above-described configuration, a signal input via the port 1 and transmitted toward the port 3 side can be expressed as follows:

$$W\sin(\omega t-\theta_1-\theta_a)+W\sin(\omega t-\theta_b-\theta_0)=W\cos\{(-\theta_1-\theta_a+\theta_b+\theta_0)/2\}\sin\{(2\omega t-\theta_1-\theta_a-\theta_b-\theta_0)/2\} \quad (1)$$

On the other hand, a signal input via the port 1 and transmitted toward the port 4 side can be expressed as follows:

$$W\sin(\omega t-\theta_1-\theta_a-\theta_0)+W\sin(\omega t-\theta_b)=W\cos\{(-\theta_1-\theta_a+\theta_b-\theta_0)/2\}\sin\{(2\omega t-\theta_1-\theta_a-\theta_b+\theta_0)/2\} \quad (2)$$

The sin terms in the equations (1) and (2) represent time-dependent changes, respectively. The cos terms represent the amplitudes and have a relation to the directivity and the coupling degree.

Accordingly, if $\cos\{\{(-\theta_1-\theta_a+\theta_b+\theta_0)/2\}$ and $\cos\{(-\theta_1-\theta_a+\theta_b-\theta_0)/2\}$ become ±1 and 0, respectively, this means that the signals flow in one direction. That is, the phase difference between $(-\theta_1-\theta_0)$ and $(-\theta_1+\theta_0)$ becomes r. Accordingly, a directional coupler can be formed by setting $(-\theta_a+\theta_b)$ at an appropriate value.

On the other hand, a signal input via the port 2 and transmitted toward the port 3 side can be expressed as follows:

$$W\sin(\omega t+\theta_2-\theta_a)+W\sin(\omega t-\theta_b-\theta_0)=W\cos\{(+\theta_2-\theta_a+\theta_b+\theta_0)/2\}\sin\{(2\omega t+\theta_2-\theta_a-\theta_b-\theta_0)/1\} \quad (3)$$

A signal input via the port 2 and transmitted toward the port 4 side can be expressed as follows:

$$W\sin(\omega t+\theta_2-\theta_a-\theta_0)+W\sin(\omega t-\theta_b)=W\cos\{(+\theta_2-\theta_a+\theta_b-\theta_0)/2\}\sin\{(2\omega t+\theta_2-\theta_a-\theta_b+\theta_0)/2\} \quad (4)$$

Referring to these equations (3) and (4), if $\cos\{(+\theta_2-\theta_a+\theta_b+\theta_0)/2\}$ and $\cos\{(+\theta_2-\theta_a+\theta_b-\theta_0)/2$ become ±1 and 0, this means that the signals flow in one direction. That is, the phase difference between $(+\theta_2-\theta_0)$ and $(+\theta_2+\theta_0)$ becomes $\pi$. Accordingly, a directional coupler can be formed by setting $(-\theta_a+\theta_b)$ at an appropriate value.

As seen in the above-description, a directional coupler can be formed, even if the interval between the pick-up positions is not limited to $\pi/2$.

According to the present invention, there is provided a directional coupler having a directional coupler which comprises at least two input-output terminals; at least two filter components; and a directional coupler comprising at least two coupling elements which are electromagnetically coupled to the filter components or a filter unit composed of the at least two filter components, a coupling line which electrically connects the at least two coupling elements to each other, and at least two coupling terminals electrically connected to the coupling line. Thus, the filter and the directional coupler are integrated with each other, and the transmission loss is reduced.

Preferably, the filter components include at least one of lumped constant elements, distributed constant lines, distributed constant resonators, plane circuits, wave guides, dielectric lines, dielectric resonators, and circuits composed of at least two laminated electrode-layers. Accordingly, the directional coupler and the filter are integrated with each other without using an especially complicated circuit.

Also, preferably, the coupling elements are ones selected from coupling probes disposed in the space defined by an inner conductor and an outer conductor or disposed in the vicinities of the filter components, coupling probes inserted into a metallic case, coupling electrode patterns formed on the surface of an insulation substrate, and reactance elements. Thus, coupling elements having a simple structure are coupled to the filter elements.

Preferably, at least one of the filter components is a multiple resonance mode element, and the coupling elements are arranged with respect to the multiple resonance mode element in such a manner that the coupling degrees for the respective resonance modes are different from each other. Accordingly, the directional coupler is integrated with the filter containing the multiple mode dielectric resonator.

Also, preferably, the number of the coupling elements is at least three, and at least one of the coupling elements is electrically connected to the coupling line in such a manner that the order in which the coupling elements are electrically connected to the coupling line is different from the order in which the coupling elements are arranged in the signal propagation direction. Accordingly, the design flexibilities of the directivity and the coupling degree are enhanced.

Preferably, the coupling elements are tip-open probes, or tip-loop probes electromagnetically connected to a ground conductor or the metallic case. Thus, the circuit can be formed irrespective of the shapes and sizes of the probes.

Further, preferably, the filter components include a capacitor comprising conductor patterns formed on the surface of an insulation substrate or comprising plural conductors arranged in the metallic case. Thus, the capacitor as the filter component can be easily formed.

Also, preferably, the coupling probes include at least one lead wire, sheet metal, coupling electrode pattern formed on the surface of an insulation substrate, coaxial line, microstrip line, and screw-shaped conductor. Thus, coupling elements each having a simple structure and a small size can be produced.

Preferably, the coupling elements or the coupling lines are provided with stub elements or reactance elements for adjusting the coupling characteristics. Thereby, the design flexibilities of the directivity and the coupling degree are enhanced.

Also, preferably, the coupling line comprises at least two line elements having different characteristic impedances. Thus, the design flexibility of the coupling line is enhanced, and the filter having a directional coupler can be easily formed.

Further, preferably, each stub element is formed so as to have a length equal to a quarter of the wavelength of the first harmonic of a transmission signal. Thus, the directivity and the coupling degree can be appropriately set. Superior directivity and coupling degree can be attained.

Also, preferably, a coupling line is arranged outside of the filter so as to be electromagnetically shielded from the filter components. Thus, the influence of a signal being transmitted through the filter upon the coupling line is suppressed.

Preferably, at least a part of the coupling line is arranged inside of the filter. Thus, the overall size of the filter having a directional coupling is reduced.

Preferably, the Metallic case is provided with holes through which members for mechanically changing the coupling elements or the coupling line are inserted inward of the metallic case. Therefore, the characteristics can be changed after construction.

Also, preferably, the metallic case is provided with screws for adjusting the characteristics of the coupling elements or the coupling line. Thus, the characteristics can be easily adjusted.

Preferably, the coupling line is provided at at least one end thereof with an attenuation circuit for attenuating an undesired mode signal excited in the coupling line. Thus, undesired signal is eliminated. Superior characteristics can be obtained.

Also, preferably, the attenuation circuit includes at least one resistor which is a variable resistor. Accordingly, the constants of the attenuation circuit can be easily changed, so that appropriate characteristics are attained.

Preferably, the coupling line has a resistor for termination connected at least one end thereof. Thus, the termination can be adequately performed, and superior transmission characteristics can be obtained.

Also, according to the present invention, the position and arrangement of the coupling probes or the shapes and sizes thereof are changed to adjust the coupling characteristic of the directional coupler. Thus, the coupling characteristic can be easily adjusted.

Preferably, the shape and size, position, and arrangement of the coupling line or the stub are changed, or a conductor or dielectric is connected to or positioned adjacent to the filter components to adjust the coupling characteristic of the directional coupler. Thus, the coupling characteristic can be easily adjusted.

Also, preferably, the length of each screw which is effective in coupling is changed so that the electromagnetic coupling degree between the filter components and the coupling element is adjusted. Thus, the electromagnetical coupling degree between the filter components and the coupling elements can be easily adjusted.

Preferably, in a composite filter device in accordance with the present invention, at least one of the filters thereof comprises the above-described filter having a directional coupler. Accordingly, a composite filter device having superior directivity and coupling degree, reduced transmission loss, and a simple structure is easily formed.

Preferably, a communication device in accordance with the present invention includes the above-described filer having a directional coupler or the above-described composite filter device having a directional coupler. Thus, a communication device having a superior transmission characteristic is easily formed.

BRIEF DESCRIPTION OF THE DRAWINGS

FIG. 1 is a block diagram of a prior art communication device;

FIG. 2 is an exploded perspective view of a prior art low-pass filter (coaxial line type);

FIG. 3 is a perspective view of a prior art low-pass filter (microstrip circuit type);

FIG. 4 is an equivalent circuit diagram of the low-pass filter;

FIG. 5 is a schematic view of a hybrid circuit;

FIG. 6 is a schematic view of a transverse coupling type directional coupler;

FIG. 7 is a schematic view of a transverse coupling type directional coupler having a multi-stage structure;

DESCRIPTION OF THE PREFERRED EMBODIMENTS

The configuration of a filter having a directional coupler according to a first embodiment of the present invention will be described with reference to FIG. 10 which is a partial perspective view of a low pass filter having a directional coupler.

Figure 8A:
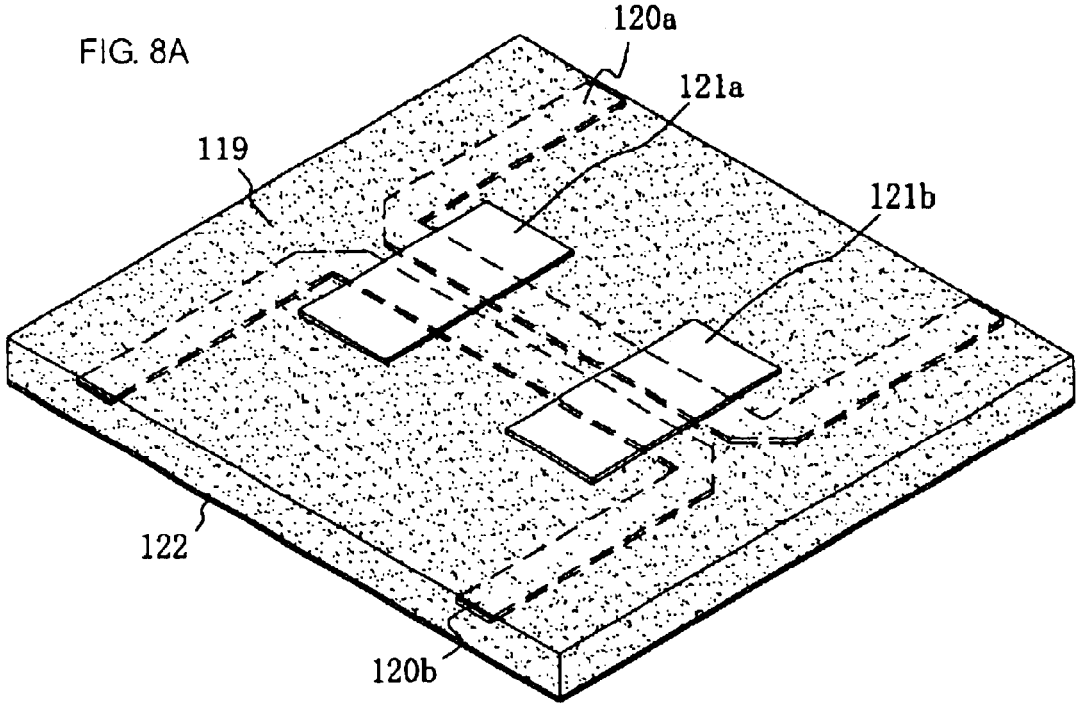
FIGS. 8A and 8B are a schematic and side view, respectively, of a transverse coupling type directional coupler having a multi-layer structure.
Figure 8B:
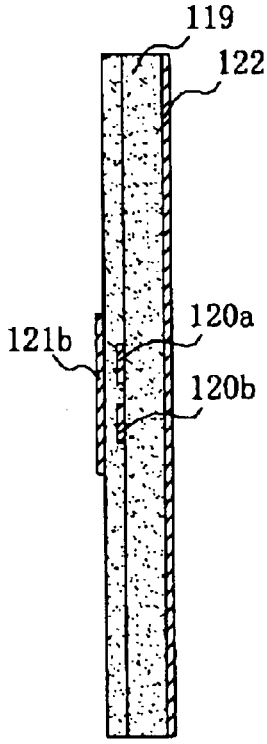
Figure 9:
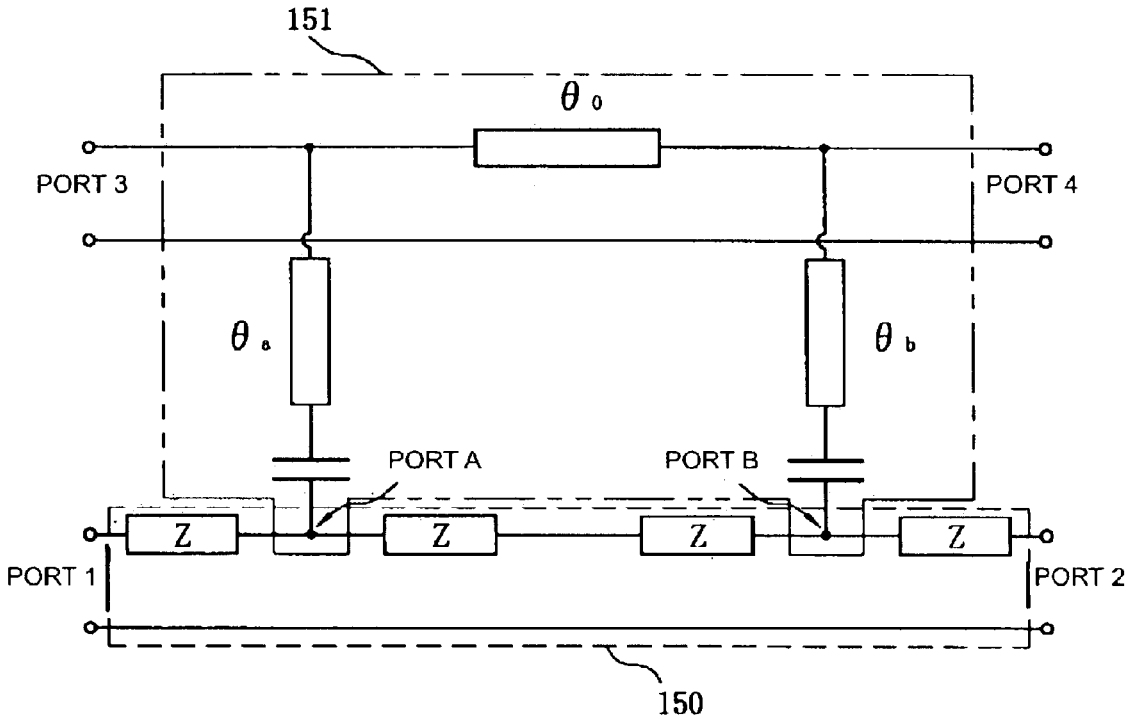
FIG. 9 is an equivalent circuit diagram of a filter having a directional coupler according to the present invention.
Figure 10:
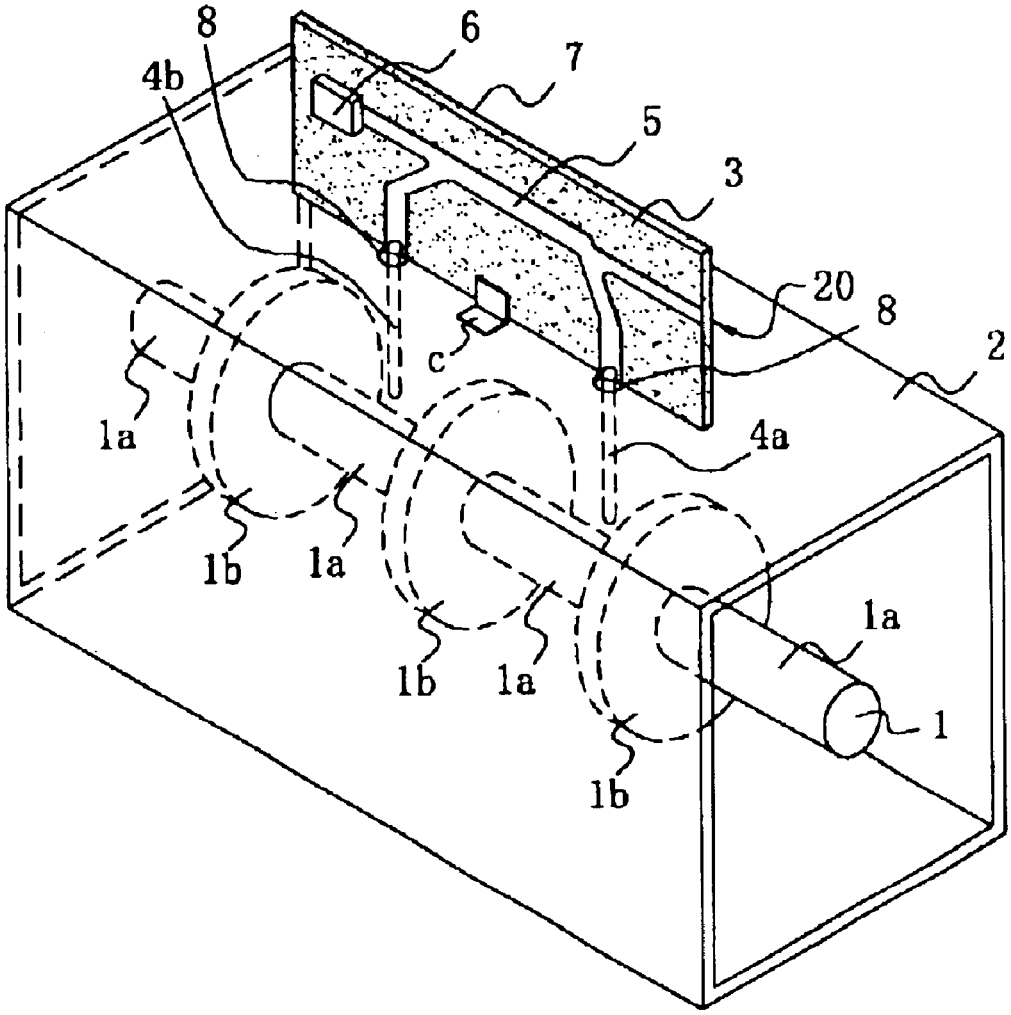
FIG. 10 is a partial perspective view of a filter having a directional coupler according to a first embodiment of the present invention.

In FIG. 10, an inner conductor 1, high impedance portions 1*a*, low impedance portions 1*b*, an outer conductor 2, a dielectric substrate 3, probes 4*a* and 4*b* as coupling elements, a coupling line 5, a resistor 6, a ground electrode 7, holes 8 for inserting the probes 4*a* and 4*b*, an output terminal 20 as a coupling terminal, and a mounting tab c are shown. The I/O terminals of the filter unit in this figure and in other figures have been omitted for clarity.

The inner conductor 1 comprises the high impedance portions 1*a* and the low impedance portions 1*b* which are formed to be connected alternately and integrally with each other. The inner conductor 1 is disposed in the center of the outer conductor 2 having a substantially square cross-section. The two holes 8 are formed in one side (the upper side in FIG. 1) of the outer conductor 2 so as to pass through the wall of the outer conductor 2.

The coupling line 5 having a substantially π-character shape is formed on the surface of the dielectric substrate 3.

The coupling line 5 comprises a main line formed in parallel to the signal transmission direction and two lines connected to the main line and also to the coupling elements, respectively. The ground electrode 7 is formed on the surface of the dielectric substrate 3 which is opposite to the surface thereof having the coupling line 5 formed thereon. The probes 4*a* and 4*b* made of conductor rods are connected to the ends of the two coupling-element connecting lines of the coupling line 5, respectively. The resistor 6 as a terminal resistor is connected to one end of the main line. That is, the resistor 6 is connected between the end of the main line and the ground electrode 7. The other end of the main line constitutes the output terminal 20 (coupling terminal). An external circuit is connected to this terminal.

Probes 4*a* and 4*b* are inserted into the holes 8, respectively. The dielectric substrate 3 is fixed to the outer wall of the outer conductor 2 by means of the mounting tab c. Thus, the dielectric substrate 3 is disposed at the predetermined position of the outer conductor 2.

According to the above-described configuration, the inner conductor 1 and the outer conductor 2 constitute a low-pass filter. The dielectric substrate 3, the coupling line 5, the ground electrode 7, the probes 4*a* and 4*b*, and the resistor 6 constitute a directional coupler.

A transmission signal entering the filter from the left rear side thereof shown in FIG. 1 is transmitted through the low-pass filter toward the right front side thereof. The probes 4*a* and 4*b* electromagnetically couple to the transmission signal, so that a part of the transmission signal is transmitted to the coupling line 5.

The coupling line 5 is designed so that a signal is transmitted only to the output terminal 20 based on the above-described principle. However, in the practical circuit, an extremely fine amount of a signal is transmitted to a terminal (a terminal connected to the resistor 6—not shown) opposite to the output terminal 20. The resistor 6 attenuates the unnecessary signal for terminal processing. As described above, the directional coupler couples to a part of the transmission signal under transmission in the low-pass filter, and the signal is transmitted only to the output terminal 20. Thus, the directional coupler performs its function.

Figure 11:
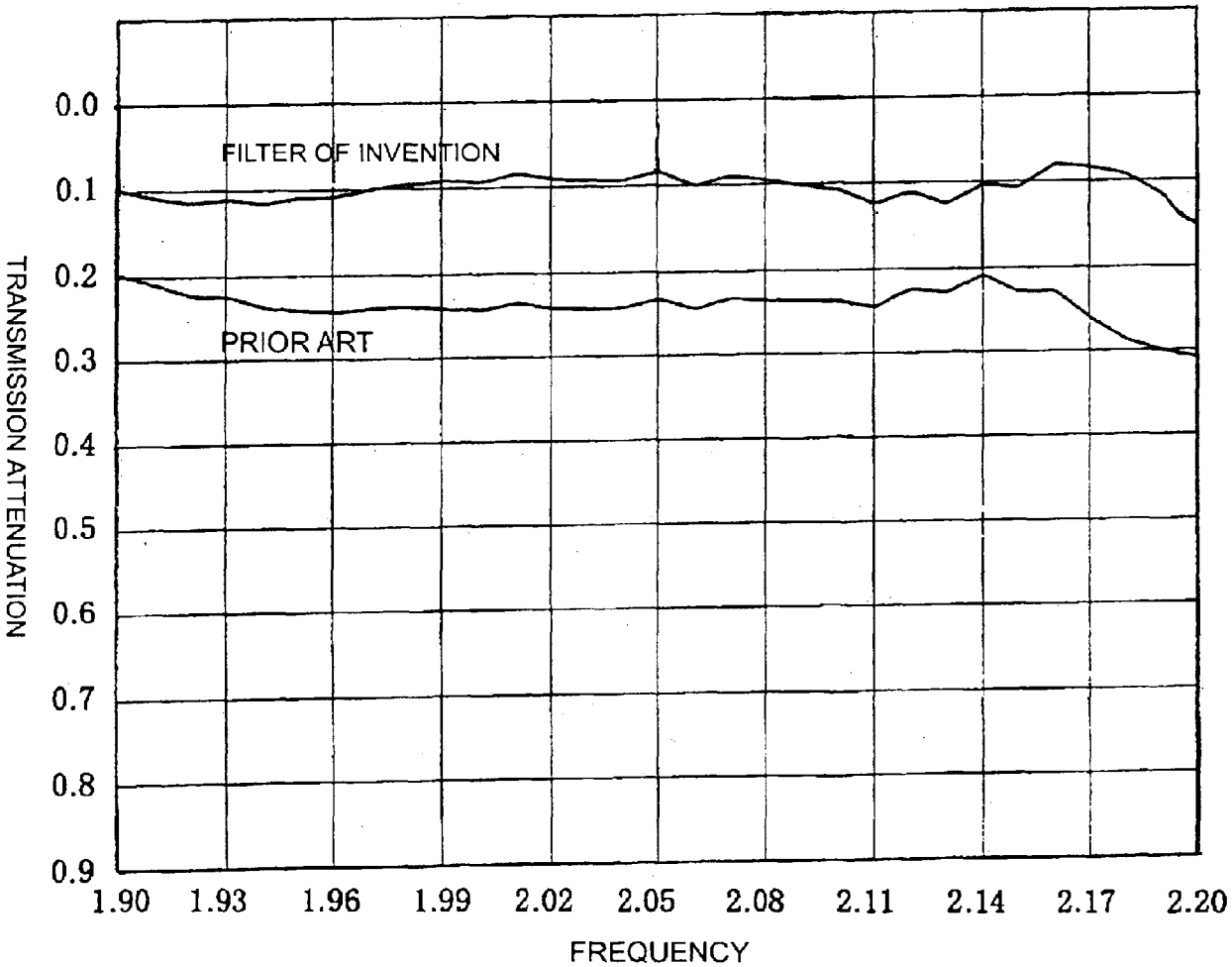
FIG. 11 is a graph showing the transmission characteristics of the low pass filter having a directional coupler of the first embodiment and a circuit in which a directional coupler and a low-pass filter are connected in series with each other.

FIG. 11 is a graph showing the transmission characteristics of a low-pass filter having the directional coupler according to this embodiment (the filter of the invention) and the circuit of the directional coupler and the low pass filter connected in series with each other (a prior art filter).

As seen in FIG. 11, the transmission attenuation of the low-pass filter having the directional coupler of this embodiment is smaller by at least about 0.1 dB, and about 0.2 dB for some frequencies, than that of the related art filter.

As described above, the directional coupler and the filter are integrated with each other. Thus, the transmission attenuation can be reduced. The space occupied by the whole filter can be decreased, that is, the size of the filter can be reduced.

Moreover, it is not necessary for the insertion interval between the probes to be restricted to $\pi/2$. Thus, design flexibility is enhanced.

Furthermore, the filter of the present invention can utilize a conventional filter. Accordingly, the investment in facilities can be suppressed.

Hereinafter, the configuration of a filter having a directional coupler according to a second embodiment of the present invention will be described with reference to FIG. 12.

Figure 12:
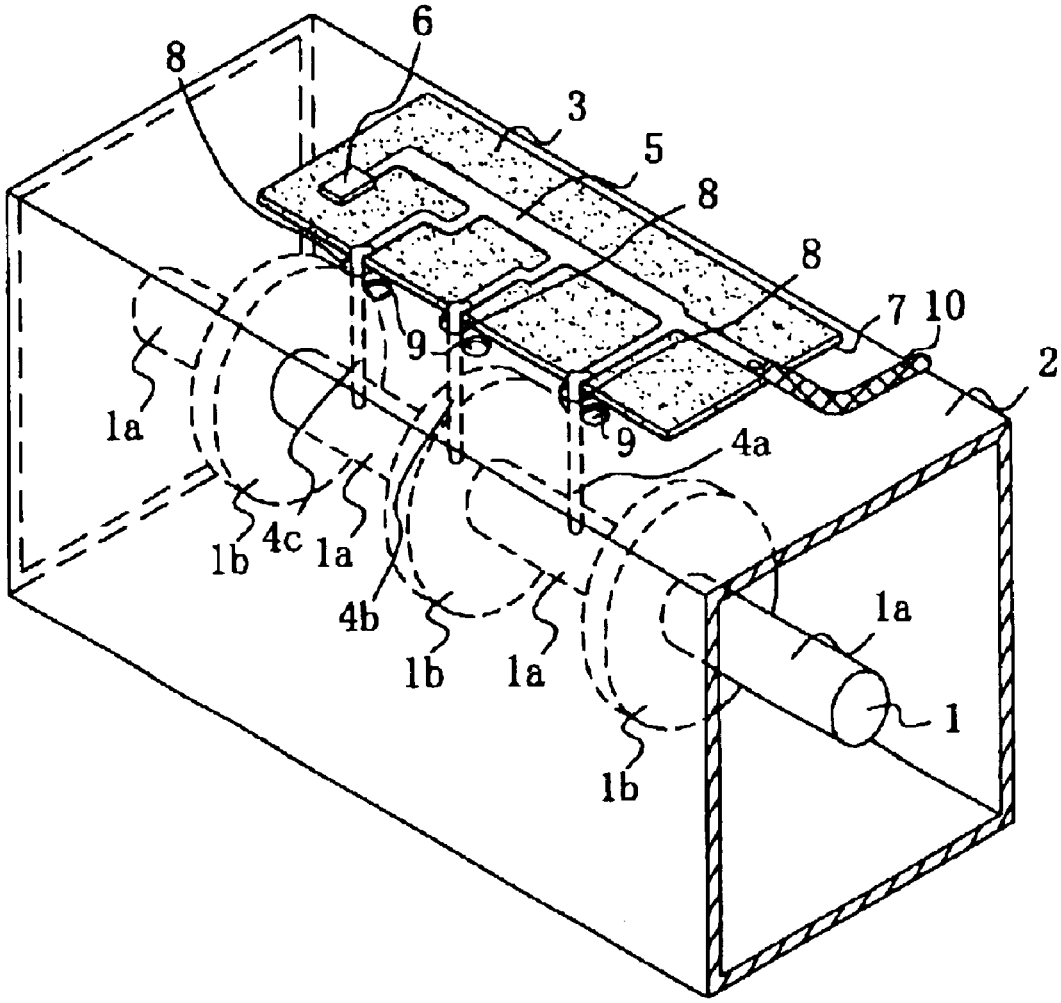
FIG. 12 is a partial perspective view of a filter having a directional coupler according to a second embodiment of the present invention.

FIG. 12 is a partial perspective view of a low-pass filter having a directional coupler.

In FIG. 12, an inner conductor 1, high impedance portions 1*a*, low impedance portions 1*b*, an outer conductor 2, a dielectric substrate 3, probes 4*a*, 4*b*, and 4*c*, a coupling line 5, a resistor 6, a ground electrode 7, holes 8 for inserting the probes, probe-adjusting holes 9, and a coaxial cable 10 connected to the output terminal are shown.

The low-pass filter comprising the inner conductor 1 and the outer conductor 2 is the same as that shown in FIG. 10. In this case, three holes 8 are formed on one side (the upper surface in FIG. 12) of the outer conductor 2 so as to pass through the wall of the outer conductor 2.

The coupling line 5 is formed on the surface of the dielectric substrate 3. The coupling line 5 comprises a main line formed in parallel to the signal transmission direction and three lines connected to the main line and also to the coupling elements, respectively. The probes 4*a*, 4*b*, and 4C made of conductor rods are connected to the ends of the three coupling-element connecting lines of the coupling line 5, respectively. The resistor 6 is connected to one end of the main line. The coaxial cable 10 is connected to the other end (output terminal) of the main line. The ground electrode 7 is formed on the surface of the dielectric substrate 3 which is opposite to the surface thereof having the coupling line 5 formed thereon.

Probes 4*a*, 4*b*, and 4*c* are inserted into the holes 8, respectively. The ground electrode surface 7 of the dielectric substrate 3 is fixed to the outer wall of the outer conductor 2. Thus, the dielectric substrate 3 is disposed at the predetermined position of the outer conductor 2.

According to the above-described configuration, the inner conductor 1 and the outer conductor 2 constitute a low-pass filter. The dielectric substrate 3, the coupling line 5, the ground electrode 7, the probes 4*a*, 4*b*, and 4*c*, and the resistor 6 constitute a directional coupler.

A transmission signal entering the filter from the left rear side thereof shown in FIG. 12 is transmitted through the low-pass filter toward the right front side thereof. The probes 4*a*, 4*b*, and 4*c* are electromagnetically coupled to the transmission signal, so that a part of the signal is transmitted to the coupling line 5.

The coupling line 5 is designed so that a signal is transmitted only to the coaxial cable 10 connected to the output terminal based on the above-described principle. An extremely fine amount of the signal transmitted in the direction opposite to the output terminal is terminated by the resistor 6. As described above, the directional coupler couples to a part of the transmission signal under transmission in the low-pass filter, and the signal is transmitted only to the coaxial cable 10. Thus, the directional coupler achieves its function.

In this case, fixtures each having a hook or the like at the tip thereof may be inserted into the holes 9, respectively, to deform the probes 4*a*, 4*b*, and 4*c*, and thereby, the coupling degree thereof to the transmission signal can be adjusted.

As described above, means for deforming the coupling elements mechanically and externally may be provided, so that the characteristics of the filter are easily adjusted after the construction.

Moreover, the whole size of the filter having a directional coupler can be reduced by fixing the main surface of the dielectric substrate to the outer conductor.

In this embodiment, the probes as coupling elements are made of conductor rods. However, probes shown in FIGS. 13A to 13F may be employed.

FIGS. 13A to 13F are partial perspective views showing the respective forms of the probes.

Figure 13A:
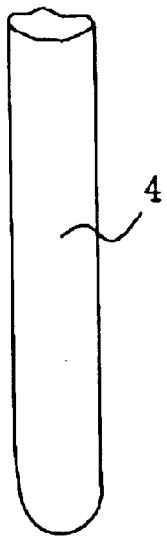
FIGS. 13A to 13F are partial perspective views showing the respective forms of the probes.

The probe shown in FIG. 13A is made of only the conductor rod 4 according to the above-described embodiment and is tip-open.

Figure 13B:
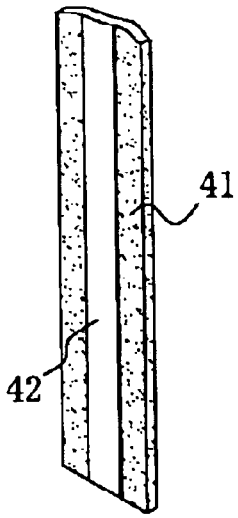

In the case of the probe shown in FIG. 13B, a coupling electrode 42 is formed on one-side surface of a dielectric substrate 41, and a ground electrode is formed on the other-side surface thereof. Thus, a microstrip line is formed, and the probe is tip-open.

Figure 13C:
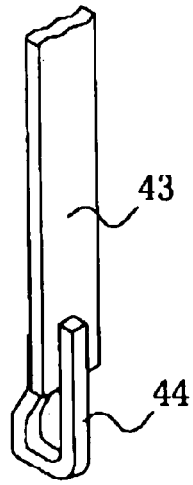

In the case of the probe shown in FIG. 13C, a substantially U-shaped electroconductive piece 44 is connected to the tip of a conductor plate 43. The substantially U-shaped conductive piece 44 functions as a loop. Thus, the probe having a loop at the tip thereof is formed.

Figure 13D:
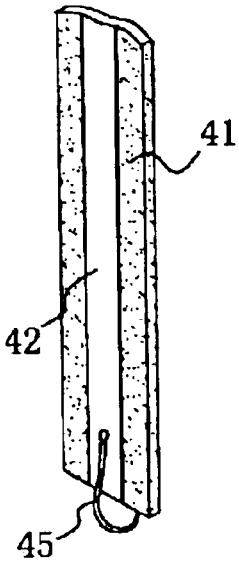

In the probe of FIG. 13D, the coupling electrodes 42 having the same shapes and sizes are formed on the opposite surfaces of the dielectric substrate 41. A conductive wire is looped at the tips of the coupling electrodes 42. Thus, the probe has a loop at the tip thereof.

Figure 13E:
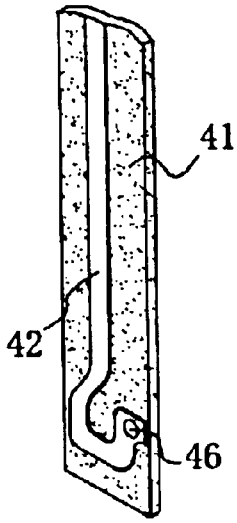

In the probe of FIG. 13E, the coupling electrodes 42 having the same shapes and sizes are formed on the opposite sides of the dielectric substrate 41, and a through-hole 46 is provided near the tips thereof, whereby a loop is formed. Thus, the probe has a loop at the tip thereof.

Figure 13F:
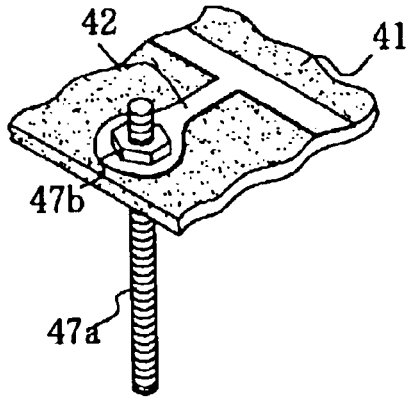

In the probe shown in FIG. 13F, a through-hole is formed near the tip of the coupling electrode 42 formed on the surface of the dielectric substrate 41. A conductor rod 47*a* having a screw-threaded surface is inserted into the through-hole. Nuts 47*b* are engaged on the conductor rod 47*a* and tightened from the upper and lower sides thereof, so that the rods 47*a* are fixed. Thus, the probe is tip-open.

Probes having different shapes and sizes as described above are available. Any probe may be selected, depending on required characteristics and setting. Moreover, different type probes may be simultaneously used.

Hereinafter, the configuration of a filter having a directional coupler according to a third embodiment will be described with reference to FIGS. 14A and 14B.

Figure 14A:
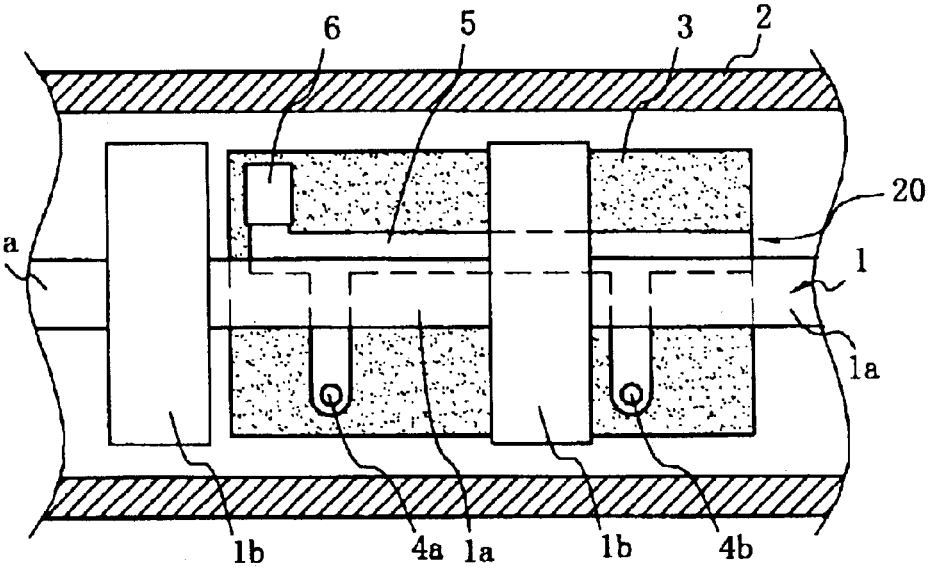
FIG. 14A is a front cross-sectional view of a filter having a directional coupler according to a third embodiment of the present invention.

FIG. 14A is a cross-sectional front view of the filter hading a directional coupler. FIG. 14B is a partial cross-sectional side view of the filter.

Figure 14B:
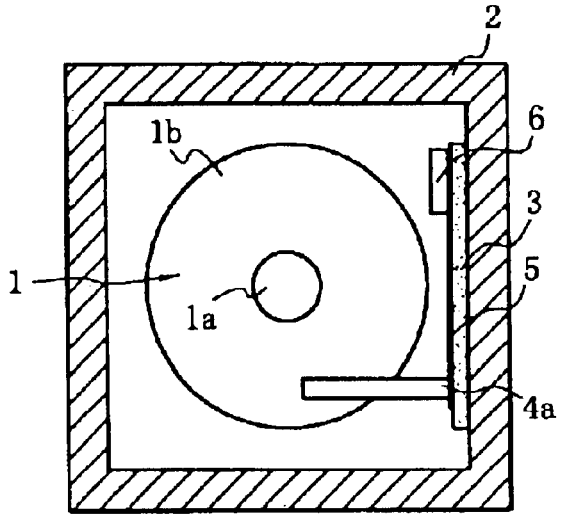
FIG. 14B is a partial side cross-sectional view of the filter.

In FIGS. 14A and 14B, an inner conductor 1, high impedance portions 1*a*, low impedance portions 1*b*, an outer conductor 2, a dielectric substrate 3, probes 4*a* and 4*b* as coupling elements, a coupling line 5, a resistor 6, and a coupling terminal 20 are shown.

The low-pass filter comprising the inner conductor 1 and the outer conductor 2 is the same as that described in the first embodiment.

A coupling line 5 having a substantially π-character shape is formed on the surface of the dielectric substrate 3. The coupling line 5 comprises a main line formed in parallel to the signal transmission direction and two lines connected to the main line and also to the coupling elements, respectively. The probes 4*a* and 4*b* made of conductor rods are connected to the ends of the two coupling-element connecting lines of the coupling line 5, respectively. The resistor 6 is connected to one end of the main line. The other end of the main line constitutes the output terminal 20 (coupling terminal). An external circuit is connected to this terminal.

The dielectric substrate 3 having the probes 4*a* and 4*b* and the resistor 6 are fixed to the inner wall of the outer conductor 2 at predetermined positions thereof. Thereby, the probes 4*a* and 4*b* are electromagnetically coupled to a transmission signal, and a part of the transmission signal is transmitted to the coupling line 5. The coupling line 5 is designed based on the previously-described principle similarly to that of the first and second embodiments. Thus, the circuit formed on the dielectric substrate 3 functions as a directional coupler.

According to the above-described configuration, the whole directional coupler is arranged inside of the filter. Accordingly, the size of the filter having the directional coupler can be reduced, that is, can be reduced to be equal to that of the filter excluding the directional coupler.

The configuration of a filter having a directional coupler according to a fourth embodiment of the present invention will be described with reference to FIGS. 15A and 15B.

Figure 15A:
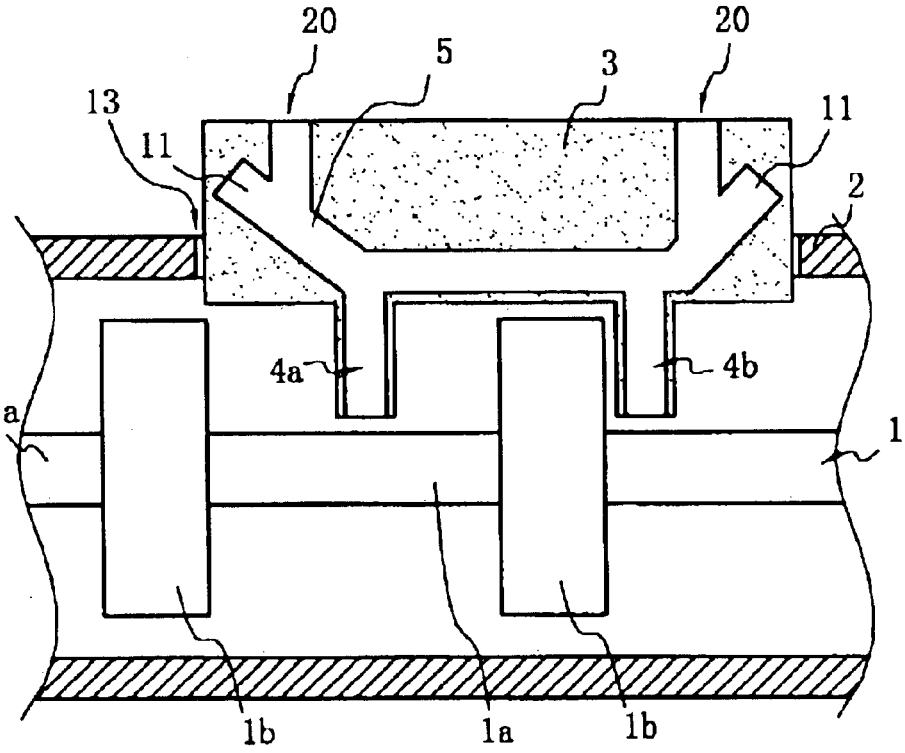
FIG. 15A is a front cross-sectional view of a filter having a directional coupler according to a fourth embodiment of the present invention.

FIG. 15A is a front cross-sectional view of the filter having a directional coupler. FIG. 6B is a partial side cross-sectional view of the filter.

Figure 15B:
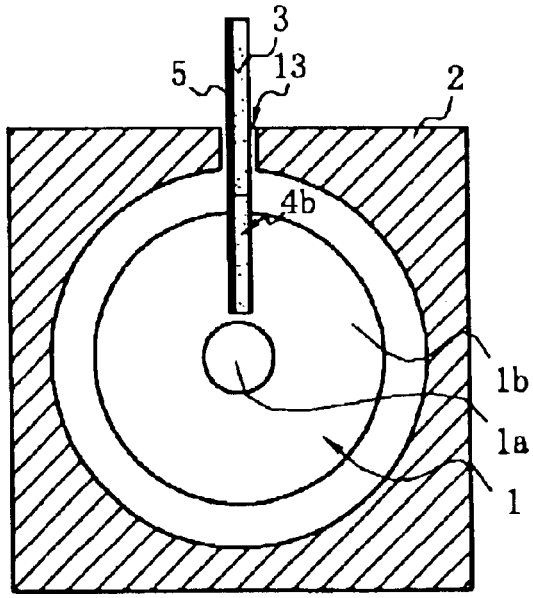
FIG. 15B is a partial side cross-sectional view of the filter.

In FIGS. 15A and 15B, an inner conductor 1, high impedance portions 1*a*, low impedance portions 1*b*, an outer conductor 2, a dielectric substrate 3, probes 4*a* and 4*b* as coupling elements, a coupling line 5, stub elements 11, a slit 13, and coupling terminals 20 are shown.

The low-pass filter comprising the inner conductor 1 and the outer conductor 2 is the same as that of the first embodiment. The slit 13 having such a size that the dielectric substrate 3 can be inserted through the slit 13 is formed on one side of the outer conductor 2.

A coupling line 5 having a substantially r-character shape is formed on the surface of the dielectric substrate 3. The coupling line 5 comprises a main line formed in parallel to the signal transmission direction and two lines connected to the main line and also to the coupling elements, respectively. The probes 4*a* and 4*b* each having a microstrip line shape are connected to the ends of the two coupling-element connecting lines of the coupling line 5, respectively. Both the ends of the main line constitute the output terminals 20 (coupling terminals), and are connected to external circuits, respectively. The at least two stub elements 11 are formed at predetermined positions of the main line.

The dielectric substrate 3 is partially inserted through the slit 13 formed in the outer conductor 2. In this case, the dielectric substrate 3 is inserted in such a manner that the main line portion (the line in parallel to the signal propagation direction) of the coupling line 5 formed on the dielectric substrate 3 does not enter the inside of the outer conductor 2.

The probes 4*a* and 4*b* comprising the microstrip lines are electromagnetically coupled to a signal being transmitted through the low-pass filter comprising the inner conductor 1 and the outer conductor 2, so that a part of the signal is transmitted to the coupling line 5. The phase of the signal input through the probe 4*a* and that of the signal input through the probe 4*b* are matched with each other, caused by the stub elements provided as described above, so that the signal is transmitted to only one of the two output terminals 20. According to the above-described configuration, the circuit formed on the dielectric substrate 3 functions as a directional coupler.

The signal is transmitted to some degree to the other of the two output terminals 20, although it is designed so that no signal is transmitted thereto. Thus, an attenuation circuit is connected to this output terminal 20 for termination, and thereby, a directional coupler having a superior directivity can be formed.

Moreover, since the main line portion is not positioned inside of the outer conductor, the main line portion is not influenced with a signal being transmitted through the outer conductor. Accordingly, a directional coupler having superior directivity and coupling degree can be formed.

The configuration of a filter having a directional coupler according to a fifth embodiment will be described with reference to FIG. 16.

Figure 16:
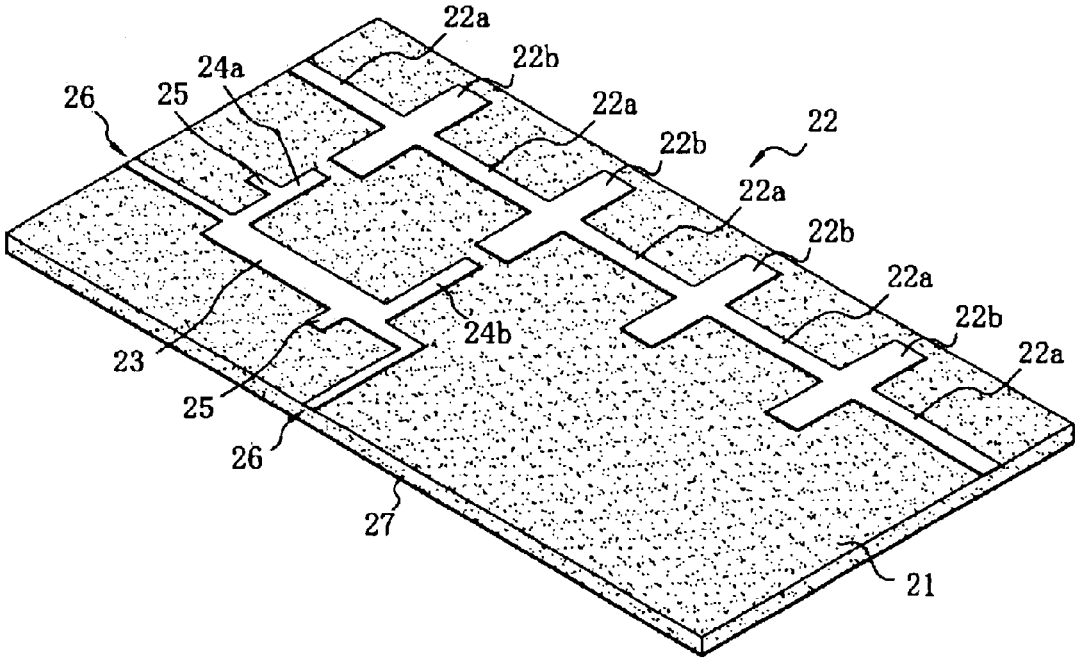
FIG. 16 is a perspective view of a filter having a directional coupler according to a fifth embodiment of the present invention.

FIG. 16 is a perspective view of a filter having a directional coupler.

In FIG. 16, a dielectric substrate 21, a line electrode 22 constituting a filter, high impedance portions 22*a* and low impedance portions 22*b* of the line electrode 22, a coupling line 23, probes 24*a* and 24*b*, stub elements 25, output terminals 26 as coupling terminals, and a ground electrode 27 are shown.

The line electrode 22 comprises the high impedance portions 22*a* and the low impedance portions 22*b*, which are formed on one surface of the dielectric substrate 21 so as to be alternately connected to each other. Each high impedance portion 22*a* has a small width and a large length with respect to the signal propagation direction. Each low impedance portion 22*b* has a large width and a small length. Moreover, the coupling line 23 is formed on the same surface of the dielectric substrate 3 as that on which the line electrode 22 is formed. The coupling line 23 comprises a main line portion in parallel to the line electrode 22, coupling-element connecting portions connected to the probes 24*a* and 24*b*, respectively, and the output terminals 26 connected to external circuits. The probes 24*a* and 24*b* are made of electrodes (coupling electrodes) formed on the surface of the dielectric substrate 21. The ground electrode 27 is formed on the other main surface (the undersurface in FIG. 16) of the dielectric substrate 21.

According to the above-described configuration, the line electrode 22, the dielectric substrate 21, and the ground electrode 27 constitute a low-pass filter containing the microstrip circuit. In this case, the coupling electrodes are formed adjacently to the line electrode 22 so as to couple to a signal being transmitted through the low-pass filter. Thus, a part of the signal is transmitted to the coupling line 23. The stub elements 25 are formed on the coupling line 23 at predetermined positions thereof. The directivity and the coupling degree are adjusted by means of the stub elements 25, so that the signal is transmitted to only one of the output terminals 26. The output terminal 26 to which no signal is transmitted is terminated. According to this configuration, the directional coupler is formed.

As described above, the filter having a directional coupler can be composed of only the plane lines provided on the surface of the dielectric substrate.

The configuration of a filter having a directional coupler according to a sixth embodiment of the present invention will be described with reference to FIGS. 17A to 17C.

Figure 17A:
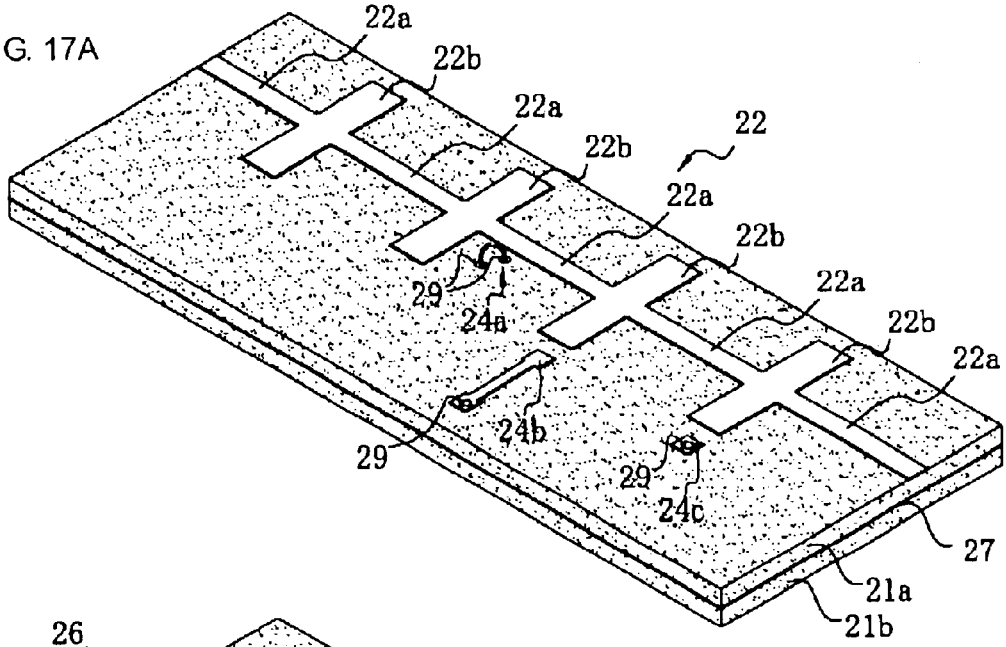
FIGS. 17A and 17B are perspective views of a filter having a directional coupler according to a sixth embodiment of the present invention and FIG. 17C is a partial cross-sectional view of the filter.

FIG. 17A is a perspective view of the filter having a directional coupler which is viewed from the upper surface side of the filter. FIG. 17B is a perspective view of the filter having a directional coupler viewed from the lower surface side thereof. FIG. 17C is a side cross-sectional view of a probe 24*a* of the directional coupler.

Figure 17B:
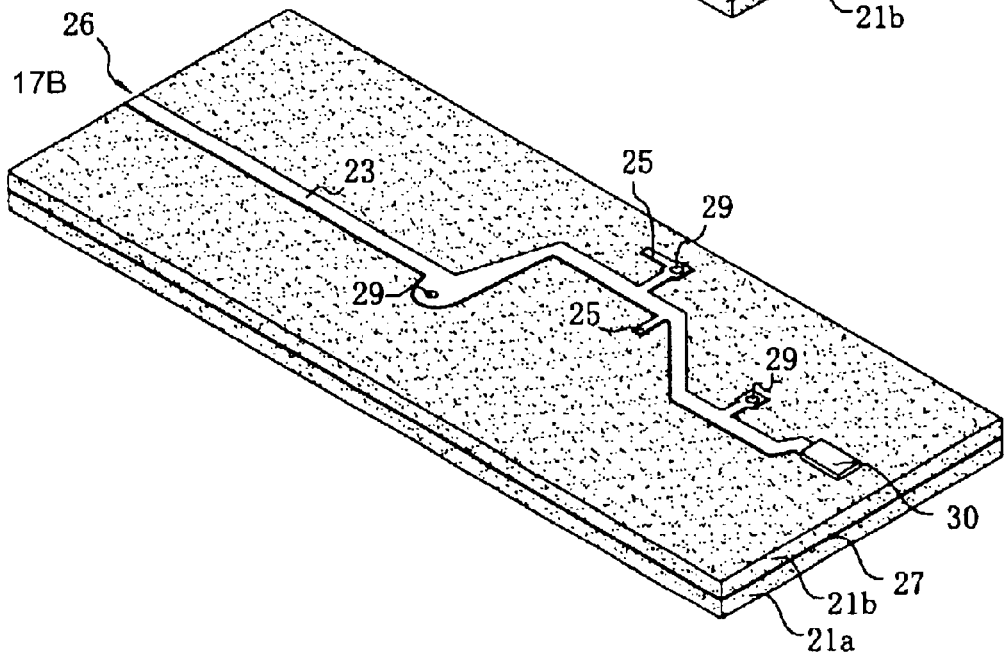
Figure 17C:
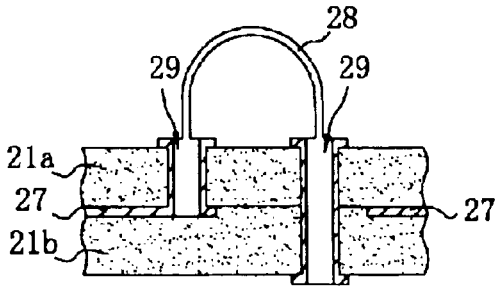

In FIGS. 17A to 17C, a dielectric substrate 21, dielectric layers 21*a* and 21*b*, a line electrode 22 constituting a filter, high impedance portions 22*a* and low impedance portions 22*b* of the line electrode 22, a coupling line 23, probes 24*a*, 24*b*, and 24*c*, stub elements 25, an output terminals 26 as a coupling terminal, a ground electrode 27, a loop wire 28, through-holes 29, and a resistor 30 are shown.

The dielectric substrate 21 comprises two dielectric layers 21*a* and 21*b*. A ground electrode 27 is formed between the layers.

The line electrode 22 is formed on the main surface of the dielectric layer 21*a* on which no ground electrode 27 is formed as described in the fifth embodiment. Thereby, a low-pass filter is formed in the dielectric layer 21*a*.

The probe 24*b* made of a linear electrode, the probe 24*c* made of a substantially rectangular electrode, and the probe 24*a* made of a loop wire 28 are provided on the main surface of the dielectric layer 21*a*.

The coupling electrode 23 is formed on the main surface of the dielectric layer 21*b* on which no ground electrode 27 is formed. The linear electrode constituting the probe 24*b*, the substantially rectangular electrode constituting the probe 24*c*, and the through-holes 29 electrically connected to the loop wire 28 constituting the probe 24*a* are also formed therein, respectively.

As shown in FIG. 17C, the probe 24*a* is formed by connecting the loop wire 28 to the coupling line 23 via one through-hole 29, and connecting the loop wire 28 to the ground electrode 27 via the other through-hole 29.

The probe 24*a* is magnetic-field coupled to a high impedance portion 22*a*, and the probe 24*b* is electric field coupled to the low impedance portion 22*b*. The probe 24*c* is electric-field coupled to another low impedance portion 22*b*.

The stub elements 25 are formed on the coupling line 23 at predetermined positions thereof. The directivity and coupling degree are adjusted by use of the stub elements 25, so that a signal is transmitted to only one of the output terminals 26. The resistor 30 is connected to the output terminal 26 to which no signal is transmitted for termination. According to the above-described configuration, a directional coupler is formed.

According to this configuration, the circuit constituting the filter and the circuit constituting the directional coupler which sandwich the ground electrode between them can be electromagnetically shielded from each other. Thus, the characteristics can be enhanced.

In this embodiment, the combination of the single filter and the directional coupler is described. Two successive filters and a directional coupler may be combined.

Hereinafter, the configuration of a filter having a directional coupler according to a seventh embodiment of the present invention will be described with reference to FIG. 18.

Figure 18:
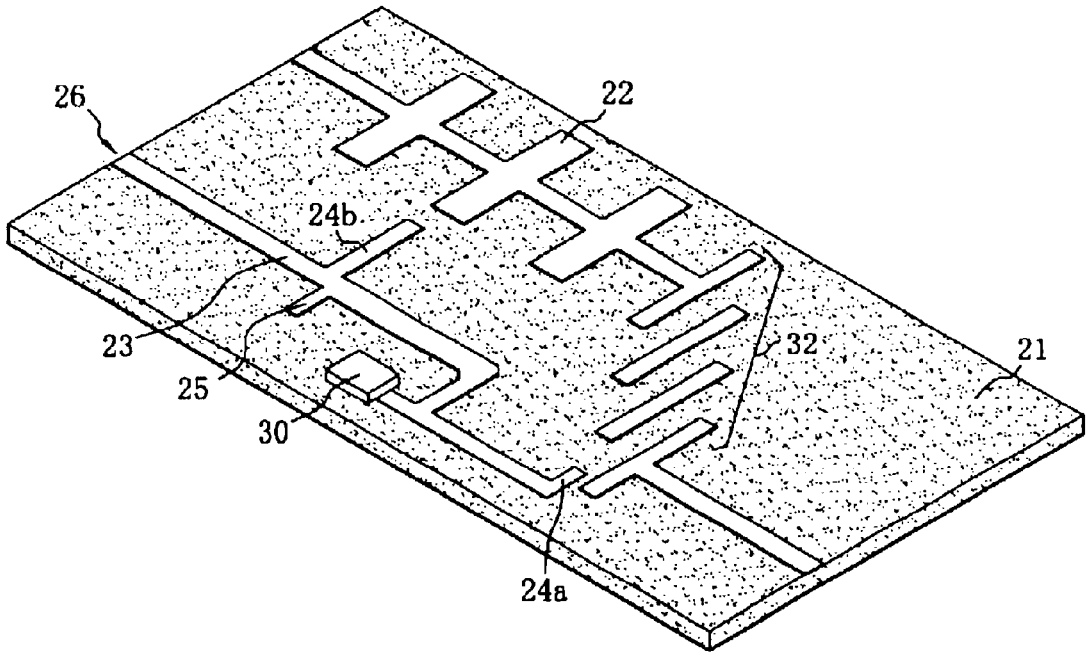
FIG. 18 is a partial perspective view of a filter having a directional coupler according to a seventh embodiment of the present invention.

FIG. 18 is a partial perspective view of a filter having a directional coupler.

In FIG. 18, a dielectric substrate 21, a line electrode 22 constituting a second filter, a line electrode group 32 constituting a first filter, a coupling line 23, probes 24*a* and 24*b*, a stub element 25, an output terminal 26, a ground electrode 27, and a resistor 30 are shown.

Similarly to the fifth and sixth embodiments, the line electrode 22 is formed on the main surface (upper surface in FIG. 18) of the dielectric substrate 21 to form a low-pass filter. The line electrode group 32 comprising a plurality of rectangular electrodes, which are extended perpendicularly to the signal propagation direction, is formed at one end of the line electrode 22. These rectangular electrodes are formed in such a manner as to be shifted by a predetermined length thereof in the perpendicular to the signal propagation direction, respectively. The line electrode group 32 formed as described above constitutes a band-pass filter.

The coupling line 23 comprising a main line portion, a coupling-element connecting portion connected to the probes 24*a* and 24*b*, respectively, the stub element 25, and the output terminal 26 are formed on the dielectric substrate 21. In this case, the electrode constituting the probe 24*a* is formed adjacently to the line electrode group 32. The electrode constituting the probe 24*b* is formed adjacently to the line electrode 22. The resistor 30 is connected to the end of the coupling line 23 to which substantially no signal is transmitted for termination. Thus, a directional coupler to be coupled to the two filters is formed.

In the above-described embodiments, several methods of forming directional couplers are described. Moreover, to match transmitted signals and adjust the directivities and coupling degrees, the configurations shown in FIGS. 19 to 21 may be employed.

Figure 19:
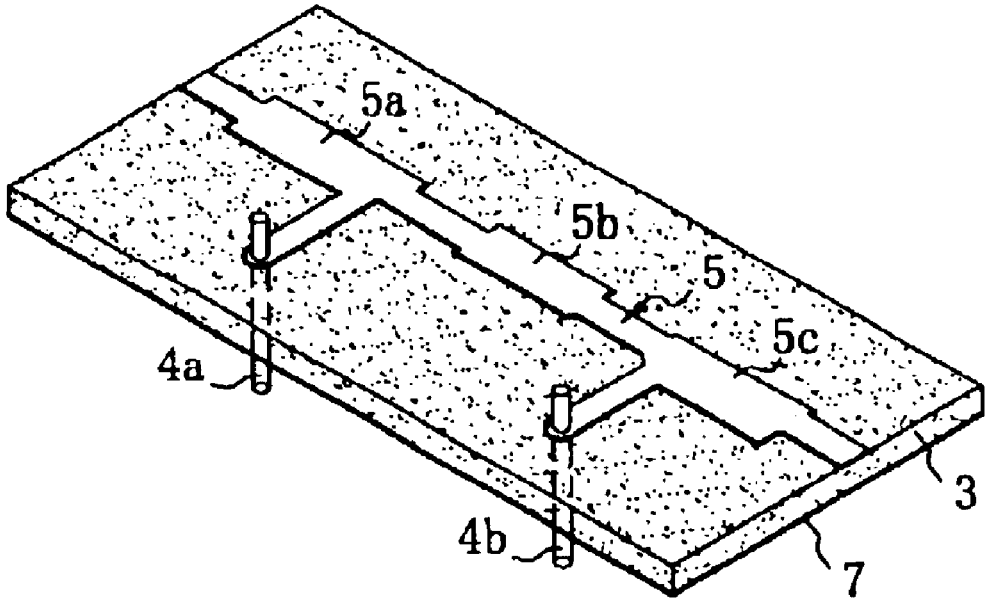
FIG. 19 is a perspective view of a dielectric substrate constituting a directional coupler.
Figure 20:
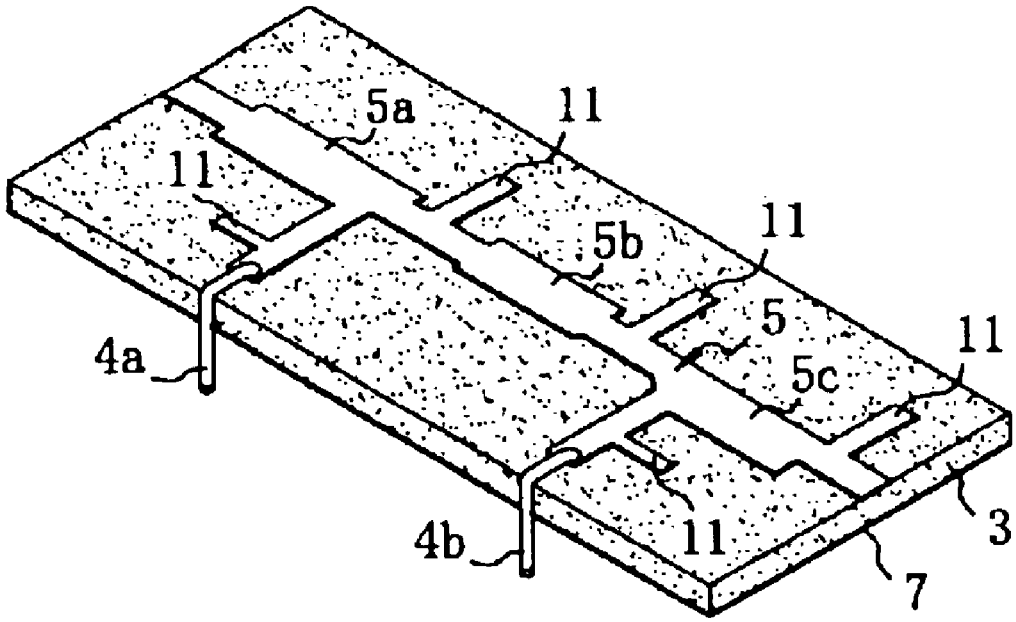
FIG. 20 is a perspective view of a dielectric substrate constituting a directional coupler.
Figure 21:
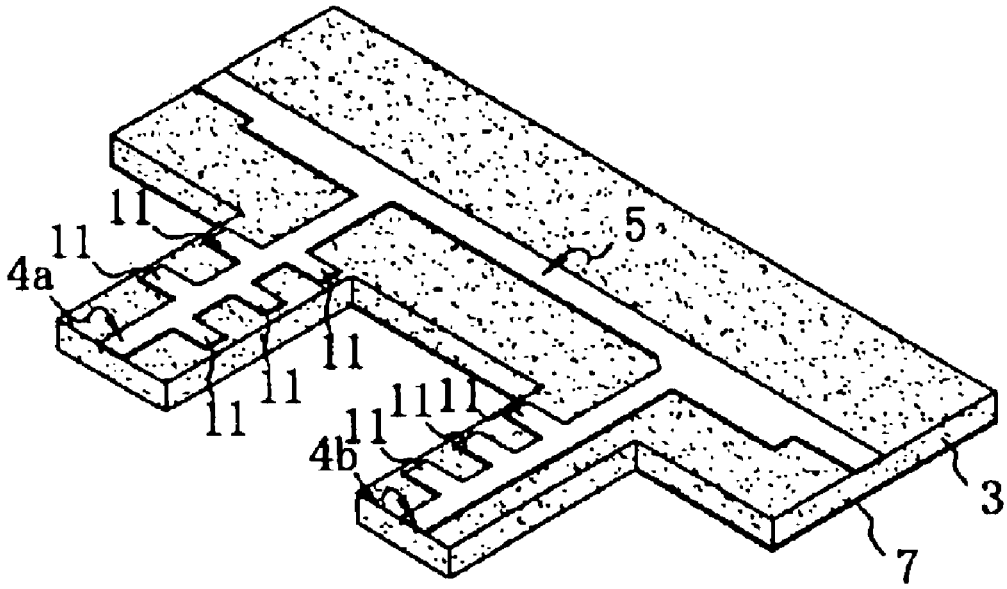
FIG. 21 is a perspective view of a dielectric substrate constituting a directional coupler.

FIGS. 19 to 21 are perspective views of dielectric substrates constituting directional couplers which employ elements different from each other.

In FIGS. 19 to 21, a dielectric substrate 3, probes 4*a* and 4*b*, a coupling line 5, parts 5*a*, 5*b*, and 5*c* of the coupling line, a ground electrode 7, and stub elements 11 are shown.

Referring to the directional coupler shown in FIG. 19, the coupling line 5 is composed of the parts 5*a*, 5*b*, and 5*c*, and thereby, the line constants are adjusted for matching.

Referring to the directional coupler shown in FIG. 20, the stub elements 11 are formed on the coupling line 5 at predetermined positions thereof, and thereby, the width of the coupling line 5 is partially changed for matching.

Referring to the directional coupler shown in FIG. 21, the stub elements 11 are provided in the vicinities of the coupling electrodes on which the probes are formed, respectively, and also, the width of the coupling line is partially changed for matching.

The matching can be performed by different methods as described above. The flexibility of the design by which desired characteristics can be attained is enhanced. Thus, a directional coupler having superior directivity and coupling degree can be easily formed.

Figure 22:
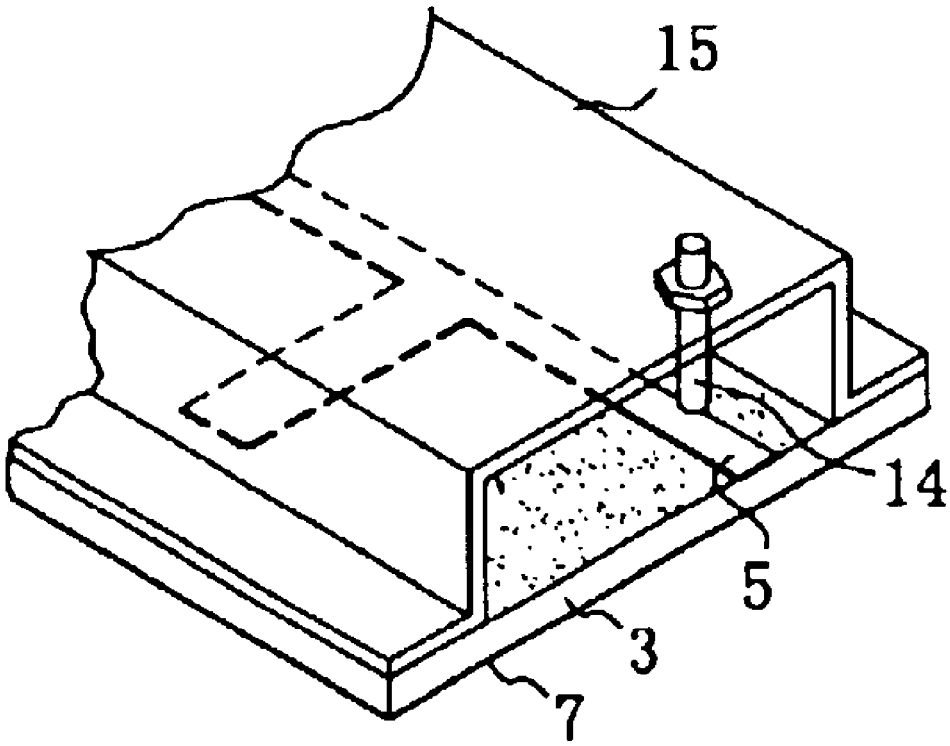
FIG. 22 is a partial perspective view of a directional coupler.
Figure 23:
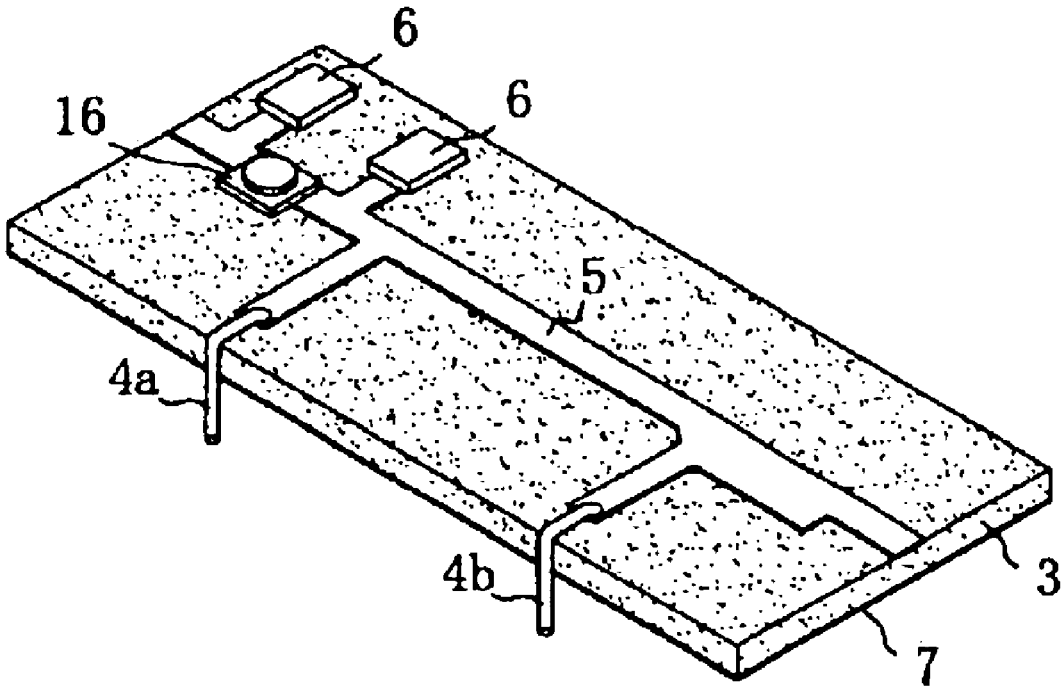
FIG. 23 is a perspective view of a directional coupler.

The directional couplers of FIGS. 22 and 23 show examples of the other structures and can be applied according to the other adjustment methods.

FIG. 22 is a partial perspective view of a directional coupler. FIG. 23 is a perspective view of another directional coupler.

In FIG. 22, a dielectric substrate 3, a coupling line 5, a ground electrode 7, a screw 23, and a casing 15 are shown. In FIG. 23, a dielectric substrate 3, a coupling line 5, probes 4*a* and 4*b*, resistors 6, a variable resistor 16, and a ground electrode 7 are shown.

In the case of a filter having the directional coupler shown in FIG. 22, the screw 14 is positioned adjacently to the coupling line 5 constituting the directional coupler. The coupling degree is adjusted by changing the interval between the screw 14 and the coupling line 5. According to this configuration, the coupling degree can be adjusted after the filter having the directional coupler is constructed.

In the directional coupler shown in FIG. 23, an attenuation circuit for termination contains plural resistors 6 and the variable resistor 16. According to this configuration, the termination can be performed by adjustment of the resistance of the variable resistor 16. Thus, a directional coupler having superior characteristics can be formed.

A filter having a directional coupler according to an eighth embodiment of the present invention will be described with reference to FIG. 24.

Figure 24:
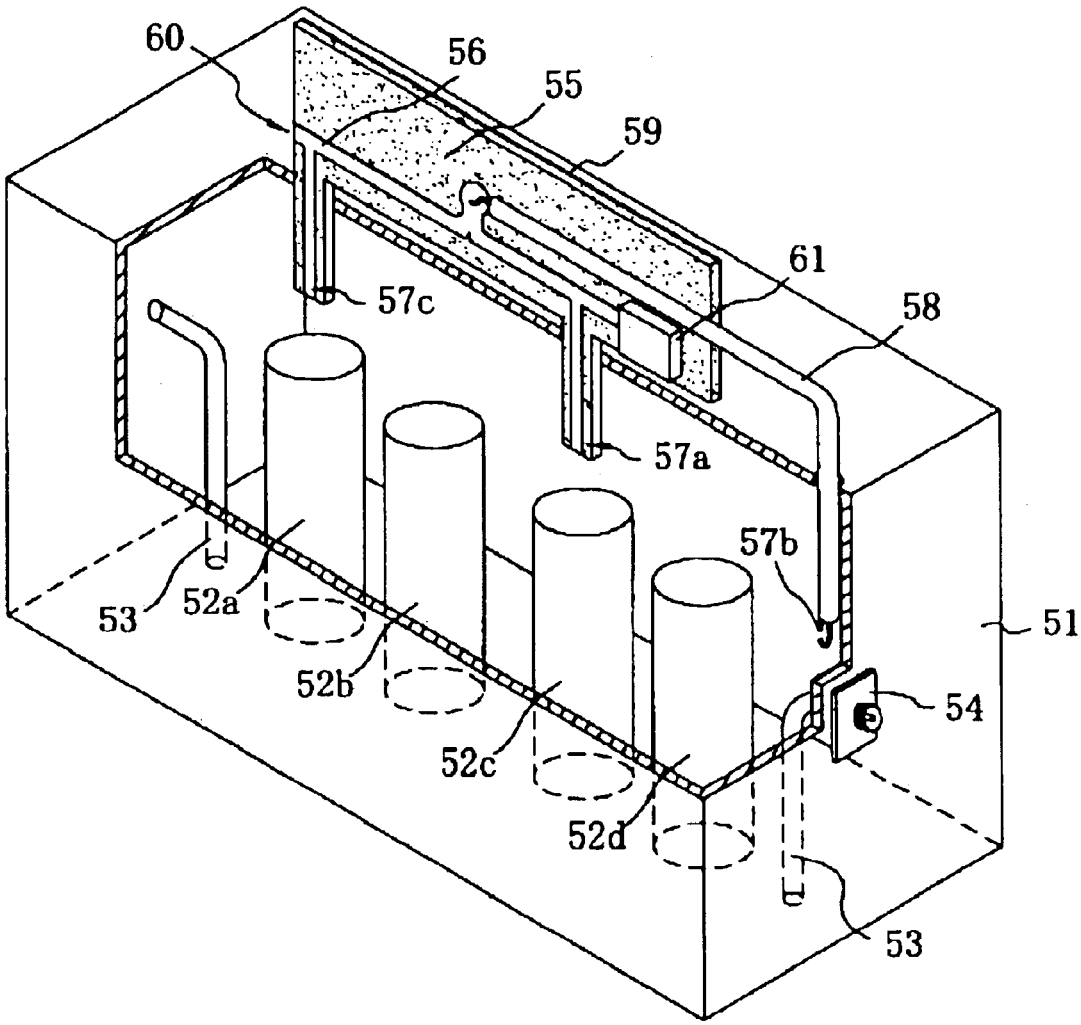
FIG. 24 is a cross-sectional perspective view of a filter having a directional coupler according to an eighth embodiment of the present invention.

FIG. 24 is a perspective cross-sectional view of the filter having a directional coupler.

In FIG. 24, an outer conductor 51, columnar inner conductors 52*a* to 52*d*, filter input-output coupling conductors 53, filter coaxial connectors 54, a dielectric substrate 55, a coupling line 56, probe electrodes 57*a* and 57*b*, a semi-rigid cable 58, a ground electrode 59, an output terminal 60 (coupling terminal) of the directional coupler, and a resistor 61 are shown.

The columnar inner conductors 52*a* to 52*d* are formed on one side of the casing constituting the outer conductor 51 so as to extend inside of the casing. The coaxial connectors 54 are provided at the ends of an arrangement comprising the inner conductors 52*a* to 52*d*. The input-output coupling conductors 53 are connected to the coaxial connectors 54 and are formed in parallel to the inner conductors 52*a* to 52*d* and over the whole length of the inner conductors 52*a* to 52*b*. According to the configuration, the inner conductors 52*a* to 52*d* function as resonators, respectively. These resonators are coupled to each other, and the inner conductors 52*a* and 52*d* constituting the resonators at both the ends are coupled to the coaxial conductors 54 via the input-output coupling conductors 53, respectively. Thus, a low-pass filter is formed.

The coupling line 56 is formed on the dielectric substrate 55 so as to be connected to probes 57*a* and 57*c* made of line electrodes, and is provided with the output terminal 60. The resistor 61 is connected to the end of the coupling line 56 opposite to the output terminal 60 for termination. The semi-rigid cable 58 is connected to the coupling line 56 at the point thereof which is between the points of the two probes 57*a* and 57*c* connected to the coupling line 56. A probe 57*b* made of a loop wire is formed at the other end of the semi-rigid cable.

Plural holes are formed in the outer conductor 51. The probes 57*a* to 57*c* are inserted via the holes inward of the outer conductor 51. In this case, the probes 57*a*, 57*b*, and 57*c* are positioned adjacently to the inner conductor 52*b*, the input-output coupling conductor 53, and the inner conductor 52*a*, respectively.

The respective probes 57*a*, 57*b*, and 57*c* are coupled to a signal which is being transmitted through the band-pass filter, and the signal is transmitted to the coupling line 56. In this case, the shapes and sizes of the probes, the shape of the coupling line, and so forth are determined so as to have predetermined set vales, based on the above-described principle. Thus, a directional coupler is formed. The directional coupler may be formed by coupling the probe to the input-output coupling conductor only.

Since the filter having a directional coupler is formed so as to have the above-described configuration, the order in which signals are picked up from a transmission signal via the probes and the order in which the probes are connected to the coupling line can be made different from each other. Accordingly, the design flexibilities of the directivity and the coupling degree are enhanced. Moreover, by using plural type conductors (coupling line and semi-rigid cable) as in this embodiment, different type wiring structures can be employed. Thus, a directional coupler can be more easily formed.

Hereinafter, a filter having a directional coupler according to a ninth embodiment of the present invention will be described with reference to FIGS. 25A and 25B.

Figure 25A:
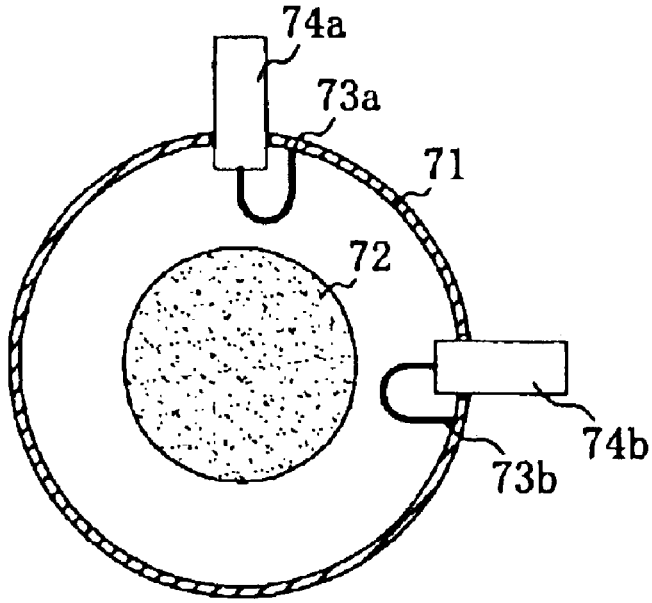
FIG. 25A is a front cross-sectional perspective view of a filter having a directional coupler according to a ninth embodiment of the present invention.

FIG. 25A is a front cross-sectional view of the filter having a directional coupler. FIG. 25B illustrates the state of an electric field generated in the filter.

Figure 25B:
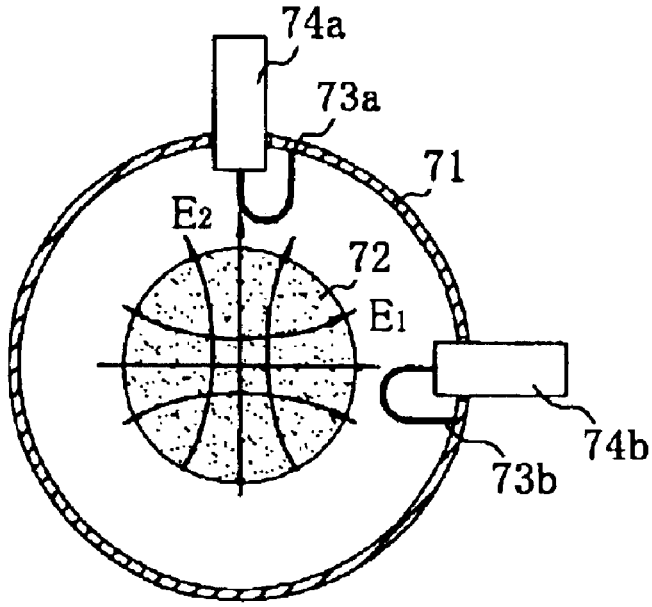
FIG. 25B illustrates the state of an electric field generated in the filter.

The filter having a directional coupler shown in FIGS. 25A and 25B comprises a dielectric resonator in which a columnar dielectric 72 is disposed in an outer conductor 71 made of a cylindrical conductor, and the axis of the dielectric 72 is coincident with that of the outer conductor 71. In this filter, as shown in FIG. 25B, two different modes, that is, double mode electric fields $E_1$ and $E_2$ are excited. These two electric fields $E_1$ and $E_2$ are coupled to each other by a predetermined means, and function as a two-stage resonator. Probes 73*a* and 73*b* each having a loop wire shape are inserted inward of the outer conductor 71. The probe 73*a* is magnetic field coupled to the electric field E1. The probe 73*b* is magnetic-field coupled to the electric field $E_2$, so that a part of a transmission signal is received. The probes 73*a* and 73*b* are connected to transmission cables 74*a* and 74*b*, respectively. The transmission cables 74*a* and 74*b* are connected to a coupling line (not shown). Thus, the signals received through the probes 73*a* and 73*b* are coupled to each other.

In this case, the probes 73*a* and 73*b* are set in such a manner that the signal picked up through the probe 73*a* and the signal picked up through the probe 73*b* have a predetermined phase difference based on the above-described principle. Thus, this directional coupler performs its function.

As seen in the above-description, for a filter comprising a multiple mode dielectric resonator, the directional coupler can be easily integrated.

In this embodiment, the dielectric resonator comprising the columnar dielectric and the cylindrical outer conductor is described. Referring to filters having containing dielectric resonators having other shapes and sizes such as dielectric resonators each having a rectangular cross-section or the like, filters having directional couplers can be formed similarly to that of the above-described embodiment.

Moreover, in the above-described embodiments, a structure in which a directional coupler integrated with a filter is described. In the case of a composite filter device provided with plural filters such as a duplexer or the like, a directional coupler can be also formed in the same manner as described above.

Hereinafter, the configuration of a communication device according to a tenth embodiment of the present invention will be described with reference to FIG. 26.

Figure 26:
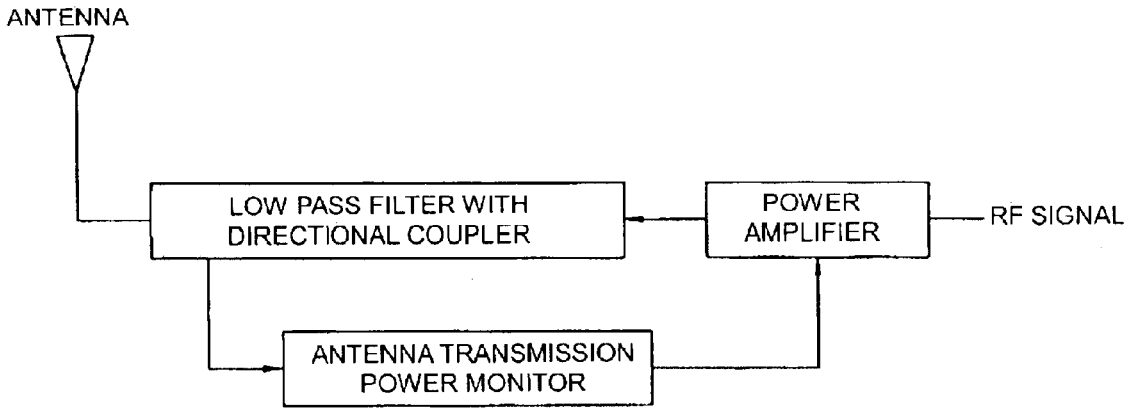
FIG. 26 is a block diagram of a communication device according to a tenth embodiment of the present invention.

FIG. 26 is a block diagram of a communication device.

In the communication device shown in FIG. 26, the higher harmonic of a transmission signal amplified by a power amplifier provided at the preceding stage is attenuated by a low-pass filter having a directional coupler, and also, a part of the transmission signal is output to an antenna transmission power monitor. The antenna transmission power monitor adjusts the output from the power amplifier correspondingly to the input signal. Thus, the output radiated from the antenna is continuously stabilized.

As the filter having a directional coupler of the communication device shown in FIG. 26, the different type filters having a directional coupler described in the embodiments are applied.

According to the above-described configuration, the overall size of the communication device can be reduced, and the transmission loss can be decreased. Thus, a communication device having superior communication characteristics can be formed.

What is claimed is:

1. A filter having a directional coupler comprising:

a filter unit comprising two input-output terminals and comprising two filter components; and a directional coupler comprising two coupling elements each of which is electromagnetically coupled to spaced points of the filter unit, a coupling line electrically connecting the two coupling elements to each other, and two coupling terminals electrically connected to the coupling line.

2. A filter having a directional coupler according to claim 1, wherein the filter components comprise at least one lumped constant element, distributed constant line, distributed constant resonator, plane circuit, wave guide, dielectric line, dielectric resonator or a circuit comprising at least two laminated electrode layers.

3. A filter having a directional coupler according to claim 1, wherein the coupling elements are selected from (a) coupling probes, (b) coupling electrode patterns disposed on the surface of an insulation substrate, and (c) reactance elements electromagnetically connected to the filter components.

4. A filter having a directional coupler according to claim 3, wherein the coupling elements are tip-open probes or tip-loop probes.

5. A filter having a directional coupler according to claim 3, wherein at least one of the filter components comprises a capacitor comprising conductor patterns disposed on the surface of an insulation substrate or arranged in a metallic case.

6. A filter having a directional coupler according to claim 3, wherein the coupling elements are probes which include at least one lead wire, sheet metal, coupling electrode pattern on the surface of an insulation substrate, coaxial line, microstrip line or screw.

7. A filter having a directional coupler according to claim 3, wherein the filter components comprise inner and outer conductors and the outer conductor is provided with holes through which members for mechanically changing the coupling elements or the coupling line are insertable inward of the outer conductor.

8. A filter having a directional coupler according to claim 1, wherein one of the filter components is provided with screws adapted to adjust the characteristics of the coupling elements or the coupling line.

9. A filter having a directional coupler according to claim 1, wherein at least one of the filter components is a multiple resonance mode element, and the coupling elements are arranged with respect to the multiple resonance mode element in such a manner that the coupling degrees for the respective resonance modes of the multiple resonance modes are different from each other.

10. A filter having a directional coupler according to claim 1, wherein there are at least three coupling elements electrically connected to the coupling line, and at least one of the coupling elements is electrically connected to the coupling line in such a manner that the order in which the coupling elements are electrically connected to the coupling line is different from the order in which the coupling elements are arranged in a signal propagation direction.

11. A filter having a directional coupler according to claim 1, wherein at least one of the coupling elements or the coupling line are provided with a stub element or reactance element adapted to adjust the coupling characteristics.

12. A filter having a directional coupler according to claim 11, wherein stub elements are provided and each stub element has a length equal to a quarter of the wavelength of the first harmonic of a transmission signal.

13. A filter having a directional coupler according to claim 1, wherein the coupling line is arranged outside of the filter unit and electromagnetically shielded from the filter components.

14. A filter having a directional coupler according to claim 1, wherein at least a part of the coupling line is arranged inside of the filter.

15. A filter having a directional coupler according to claim 1, wherein at least one end of the coupling line is provided with an attenuation circuit adapted to attenuate an undesired mode signal excited in the coupling line.

16. A filter having a directional coupler according to claim 15, wherein the attenuation circuit comprises a variable resistor.

17. A filter having a directional coupler according to claim 1, wherein the coupling line comprises at least two line elements having different characteristic impedances.

18. A filter having a directional coupler according to claim 1, wherein the coupling line has an end and a resistor connected to the end.

19. A method of adjusting the coupling characteristic of the filter having a directional coupler defined in claim 1 comprising:

adjusting the coupling characteristic of the directional coupler by changing the position, arrangement or physical attribute of the coupling elements.

20. A method of adjusting the coupling characteristic of the filter having a directional coupler defined in claim 1 comprising:

adjusting the coupling characteristic of the directional coupler by changing a physical attribute of the coupling line, or by disposing a conductor or dielectric connected to or adjacent to the filter components.

21. A method of adjusting the coupling characteristic of the filter having a directional coupler defined in claim 6 comprising:

adjusting the coupling characteristic of the directional coupler by changing the length of a screw to thereby alter the electromagnetic coupling degree between the filter components.

22. A composite filter device having a directional coupler comprising:

two filters each including at least two filter components and at least two input-output terminals coupled to filter components, respectively; and a directional coupler coupled to the two filter components in the two filters or coupled to the input-output terminals;

wherein at least one of the filters is a filter having the directional coupler defined in claim 1.

23. A communication device including the composite filter device having a directional coupler defined in claim 22.

24. A communication device including the filter having a directional coupler defined in claim 1.

* * * * *